US012385712B2

(12) United States Patent
Khoshnood

(10) Patent No.: US 12,385,712 B2
(45) Date of Patent: Aug. 12, 2025

(54) SLINGSHOT

(71) Applicant: Bahram Khoshnood, Alpharetta, GA (US)

(72) Inventor: Bahram Khoshnood, Alpharetta, GA (US)

( * ) Notice: Subject to any disclaimer, the term of this patent is extended or adjusted under 35 U.S.C. 154(b) by 114 days.

(21) Appl. No.: 18/222,134

(22) Filed: Jul. 14, 2023

(65) Prior Publication Data

US 2024/0263909 A1 Aug. 8, 2024

Related U.S. Application Data

(63) Continuation-in-part of application No. 18/114,581, filed on Feb. 27, 2023, and a continuation-in-part of application No. 18/107,160, filed on Feb. 8, 2023.

(51) Int. Cl.
*F41B 3/02* (2006.01)
*F41B 3/00* (2006.01)

(52) U.S. Cl.
CPC ..... *F41B 3/005* (2013.01); *F41B 3/02* (2013.01)

(58) Field of Classification Search
CPC ..... F41B 3/005; F41B 3/02; A63B 65/12
USPC ..... 124/17
See application file for complete search history.

(56) References Cited

U.S. PATENT DOCUMENTS 271,568 A * 1/1883 Bower ..... F41B 3/02 124/45
1,960,645 A * 5/1934 Parrish ..... F41B 3/02 124/45
2,715,895 A * 8/1955 Loveless ..... F41B 3/02 124/20.3
2,735,417 A * 2/1956 Denekar ..... F41B 3/02 124/80
3,270,734 A * 9/1966 Clements ..... F41B 3/02 124/50
3,494,346 A * 2/1970 Yount ..... F41B 3/02 124/80
3,728,996 A * 4/1973 Miller ..... F41B 3/02 124/20.3
3,923,034 A * 12/1975 Wolf ..... F41B 3/02 124/80
4,198,949 A * 4/1980 Cook ..... F41B 3/02 33/263
4,274,387 A * 6/1981 McBride ..... F41B 3/02 124/20.2

(Continued)

*Primary Examiner* — John E Simms, Jr.
(74) *Attorney, Agent, or Firm* — Walter A. Rodgers

(57) ABSTRACT

An improved slingshot comprises a grip comprising a handle, a first arm coupled to the handle and a second arm coupled to the handle, a resiliently stretchable sling comprises a first resiliently stretchable band comprising a first end and an opposite second end, a second resiliently stretchable band comprising a third end and an opposite fourth end, a first mounting formation integrally formed with the first band second end, a second mounting formation integrally formed with the second band fourth end, and a first pouch integrally formed with the first band first end and the second band third end. The first resiliently stretchable band, the second resiliently stretchable band, the pouch and the first and the second mounting formations are all formed from the same material, where the first mounting formation is configured to be releasably attached to the first arm, and the second mounting formation is configured to be releasably attached to the second arm.

7 Claims, 16 Drawing Sheets

(56) References Cited

U.S. PATENT DOCUMENTS

| | | | | | |
|---|---|---|---|---|---|
| 4,307,699 | A * | 12/1981 | Cuesta | F41B 3/02 | 124/80 |
| 4,722,316 | A * | 2/1988 | Stinnett | F41B 3/02 | 124/16 |
| 9,605,922 | B1 * | 3/2017 | Rowe | F41B 3/005 | |
| 2010/0300419 | A1 * | 12/2010 | Saunders | F41B 3/02 | 29/525.08 |

* cited by examiner

SLINGSHOT

BACKGROUND

The present invention relates generally to sling shot rifles for shooting arrows and metal balls or pellets. More particularly, the present invention relates to a sling shot rifle having a trigger mechanism, a rail, an improved elastic pouch, and projectiles for use in the sling shot rifle.

Sling shot rifles have been in existence for some time. For example, U.S. Pat. No. 9,395,139 discloses a sling shot rifle that comprises a stock and butt having a trigger mechanism. Two rubberized bands 31 are coupled on one end to a respective spaced arm 18 and on the other end to a pocket 30. A loop 42 is coupled on one end to the pocket 30 and on an opposite end to a washer 100. The washer is used to couple the patch to a fire mechanism block 38.

The designs disclosed above for shooting arrows or round projectiles present many problems for the user. For example, in the case of both the sling shot rifle for shooting arrows or round metal projectiles, one of the many issues centers around the rubberized bands impart uneven reactive forces on the arrow or the sack when in the cocked position thereby causing the projectile or arrow to not fly where the shooter expects. Said another way, if one band exerts more force on one side of the pocket or the arrow, then the flight path of the arrow or the projectile can be off center making it more difficult for the user to hit their target. The present invention seeks to address many of the concerns that arise with modern sling shot guns shown in the prior art.

SUMMARY OF THE INVENTION

In various embodiments, an improved slingshot comprises (1) a first resiliently stretchable band comprising a first end and an opposite second end, (2) a second resiliently stretchable band comprising a third end and an opposite fourth end. (3) a first mounting formation coupled to the first band second end, (4) a second mounting formation coupled to the second band fourth end, and (5) a pouch coupled intermediate the first band first end and the second band third end. In various embodiments, the first resiliently stretchable band, the second resiliently stretchable band, the pouch and the first and the second mounting formations are all integrally formed with one another. In some embodiments, the resiliently stretchable first and second bands, the pouch and the first and second mounting formations are all formed from a material selected from a group consisting of (1) rubber, (2) an elastomer, (3) a compounded rubber, (4) a compounded latex. (5) neoprene, and (6) dipped latex tubing.

In various embodiments, the first and second mounting formations are substantially flat. In other embodiments, the first and second mounting formations are substantially cylindrical in shape.

In still other embodiments, the improved slingshot further comprises a grip comprising (1) a handle, (2) a first arm coupled to the handle, and a second arm coupled to the handle. In some of these embodiments, the first arm is configured to releasably receiving the first mounting formation and the second arm is configured to releasably receive the second mounting formation. In some embodiments, the first arm further comprises a first slot and the second arm further comprises a second slot. In some of these embodiments, the first slot is sized and shaped to releasably receive the first mounting formation, and the second slot is sized and shaped to releasably receive the second mounting formation.

In various embodiments, the pouch defines a cavity therein that is shaped to receive a projectile. In some embodiments, the shape of the pouch cavity is selected from a group consisting of (1) circular, (2) semicircular, (3) substantially cylindrical, (4) square, and (5) rectangular.

In yet another embodiments, an improved slingshot comprises (1) a grip comprising (a) a handle, (b) a first arm coupled to the handle, and (c) a second arm coupled to the handle, and (2) a resiliently stretchable first sling comprises (a) a first resiliently stretchable band comprising a first end and an opposite second end. (b) a second resiliently stretchable band comprising a third end and an opposite fourth end, (c) a first mounting formation integrally formed with the first band second end. (d) a second mounting formation integrally formed with the second band fourth end, (e) a first pouch integrally formed with the first band first end and the second band third end. In various embodiments, the first resiliently stretchable band, the second resiliently stretchable band, the pouch and the first and the second mounting formations are all formed from the same material. In some embodiments, the first mounting formation is configured to be releasably attached to the first arm, and the second mounting formation is configured to be releasably attached to the second arm. In various embodiments, the material is rubber. In other embodiments, the material is latex. In some embodiments, the pouch defines a cavity therein that is substantially semicircular.

In various embodiments, the improved slingshot further comprises a second sling comprising (1) a third resiliently stretchable band comprising a fifth end and an opposite six end, (2) a fourth resiliently stretchable band comprising a seventh end and an opposite eighth end, (3) a third mounting formation integrally formed with the third band sixth end, (4) a fourth mounting formation integrally formed with the fourth band eighth end, and (5) a second pouch integrally formed with the third band fifth end and the fourth band seventh end. In some embodiments, the third resiliently stretchable band, the fourth resiliently stretchable band, the second pouch and the third and the fourth mounting formations are all formed from the same material, the third mounting formation is configured to be releasably attached to the first arm, and the fourth mounting formation is configured to be releasably attached to the second arm. In various embodiments, the first pouch defines a first cavity having a first shape, the second pouch defines a second cavity having a second shape, and the first shape and the second shape differ.

In various embodiments, the first mounting formation is substantially flat, and the second mounting formation is substantially flat. In some of these embodiments, the first mounting formation is releasably attached to the first arm using a first clip, and the second mounting formation is releasably attached to the second arm using a second clip. In other embodiments, the first arm comprises a first slot formed therein that is configured to releasably receive one of the first mounting formation and the third mounting formation therein, and the second arm comprises a second slot formed therein that is configured to releasably receive one of the second mounting formation and the fourth mounting formation therein.

In yet another embodiment of an improved slingshot, the slingshot comprises (1) a first resiliently stretchable band comprises a first end and an opposite second end. (2) a second resiliently stretchable band comprising a third end and an opposite fourth end, and (3) a pouch coupled intermediate the first band first end and the second band third end. In some of these embodiments, the pouch defines a cavity therein that is shaped and sized to releasably receive a projectile therein, and the first resiliently stretchable band, the second resiliently stretchable band and the pouch are all integrally formed with one another from the same resiliently stretchable material. Some of these embodiments further comprises a grip comprising (1) a handle, (2) a first arm operatively coupled to the handle, and a second arm operatively coupled to the handle. In some embodiments, the first resiliently stretchable band second end is configured to be coupled to the first arm, and the second resiliently stretchable band fourth end is configured to be coupled to the second arm. In some embodiments, the first resiliently stretchable band second end is configured to be releasably coupled to the first arm, and the second resiliently stretchable band fourth end is configured to be releasably coupled to the second arm.

BRIEF DESCRIPTION OF THE DRAWINGS

Various embodiments of an apparatus, system, and method for utilizing a slingshot rifle having an elongated rail, a stock, and an elasticized pouch are described below. In the course of this description, reference will be made to the accompanying drawings, which are not necessarily drawn to scale, and wherein:

FIG. 9A is an exploded view and FIG. 9B is a sectional view;

DETAILED DESCRIPTION

Various embodiments now will be described more fully hereinafter with reference to the accompanying drawings. It should be understood that the invention may be embodied in many different forms and should not be construed as limited to the embodiments set forth herein. Like numbers refer to like elements throughout.

Description of Sling Shot Rifle

Figure 1:
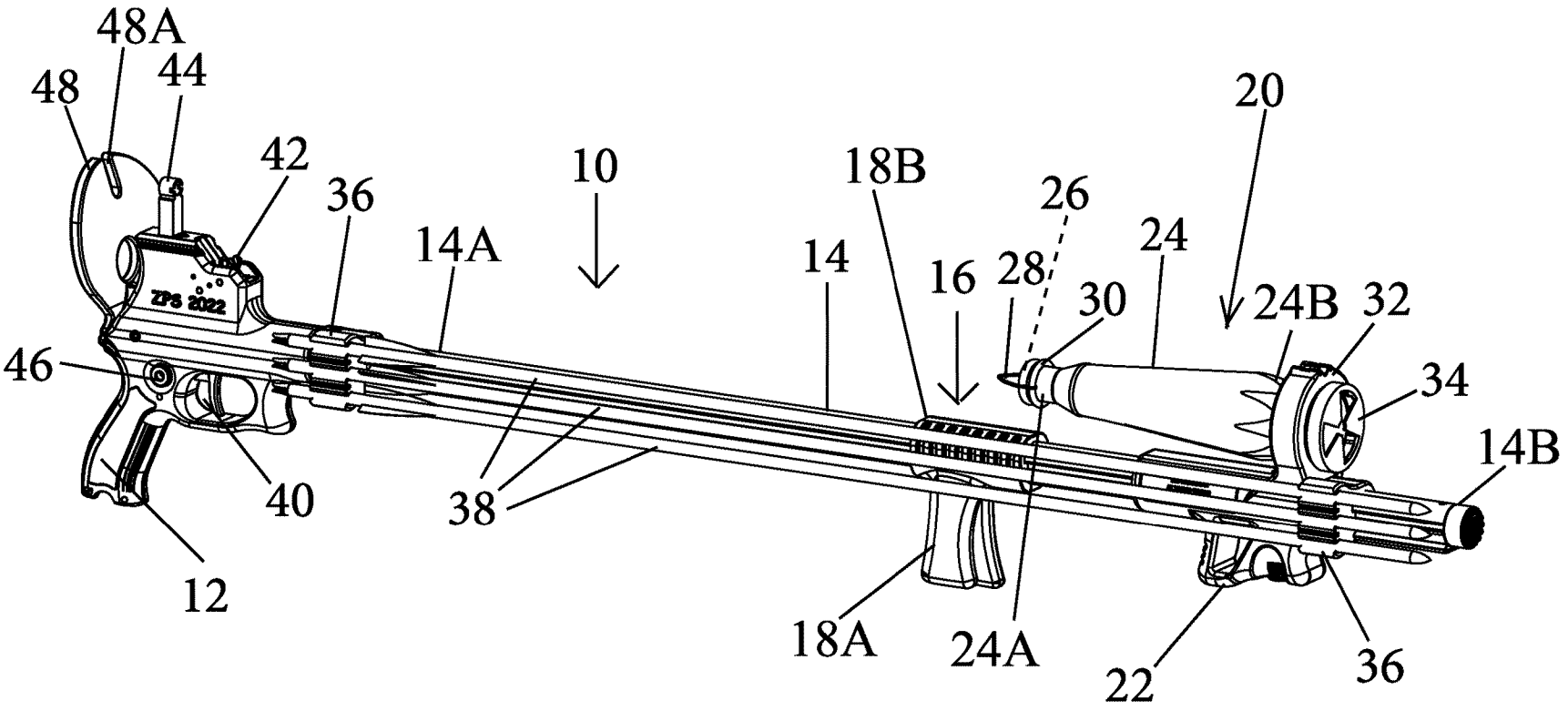
FIG. 1 is a perspective view of an embodiment of a sling shot rifle having a rail and a resiliently stretchable pouch.

Referring to FIG. 1, a sling shot rifle 10 having a stock 12, an elongated rail 14 having a first end 14A coupled to the stock, a slide grip 16, and a resiliently stretchable launch mechanism 20. The slide grip 16 comprises a grip handle 18A coupled to a generally cylindrical body 18B that is received on the elongated rail 14. Resiliently stretchable launch mechanism 20 comprises a generally cylindrical body 22 that is received on the elongated rail 14, a resiliently stretchable pouch 24 having a first end 24A and an opposite second end 24B.

Figure 2:
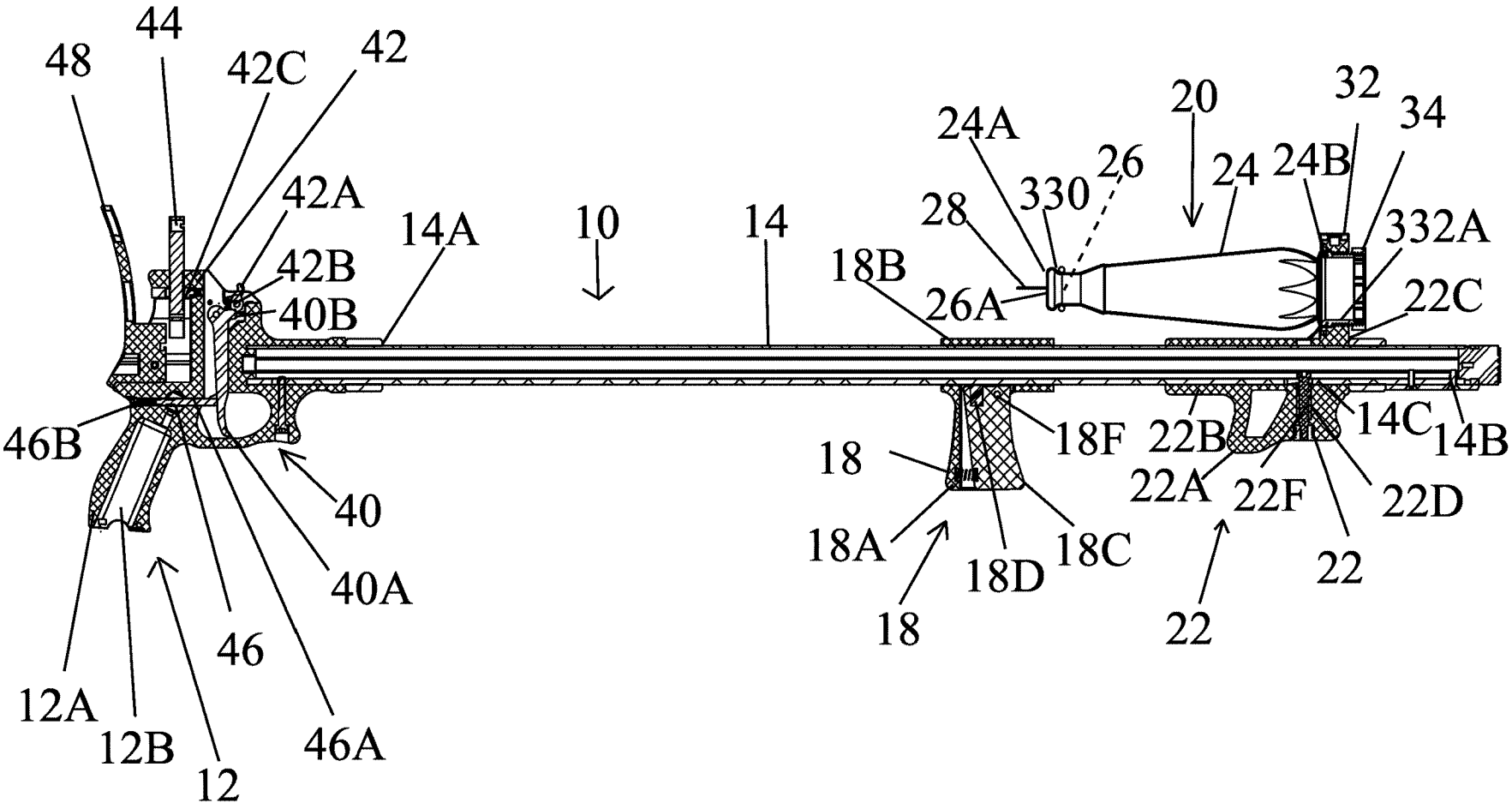
FIG. 2 is a side sectional view of the sling shot rifle of FIG. 1.

Resiliently stretchable pouch first end 24A contains within the pouch a generally cylindrical reinforced body 26 having a head (FIG. 2: 26A) with a larger diameter then the cylindrical body 26 (FIG. 2). A ring 30 made from any suitable material such as stainless steel, carbon fiber, a polymer, etc. is slid on the outside of resiliently stretchable pouch 24 along generally cylindrical reinforced body 26 until it seats against the head 26A (shown in FIG. 2). A loop 28 made from stainless steel wire, a polymer, carbon fiber material, etc. or any other suitable material is then coupled to ring 30 on opposite sides of ring 30. Loop 28 may be coupled by weldments, tying the loop material to ring 30 or by any other suitable means of coupling the ends of the loop material to ring 30.

Second end 24B of resiliently stretchable pouch 24 is coupled to generally cylindrical body 22. In various embodiments, generally cylindrical body 22 has a circular mounting body 32 either integrally formed with, or coupled to, generally cylindrical body 22. Second end 24B of resiliently stretchable pouch 24 can be secured to the circular mounting body in various suitable ways. In some embodiments, circular mounting body 32 may be formed from a first fixed body and a second insert body that allows the user to fold second end 24B of the resiliently stretchable pouch 24 over the first ring before it is removably inserted into the first fixed body. In other embodiments, second end 24B of the resiliently stretchable pouch 24 may be glued to circular mounting body 32. In still other embodiments, second end 24B of resiliently stretchable pouch 24 may be formed with an integral circular flange that may be coupled to circular mounting body 32 in various ways to secure second end 24B of the resiliently stretchable pouch to circular mounting body 32. A front cover 34 is formed from a flexible material such as rubber, polymer, elastomer, bristles, or any other suitable material that function as an arrow rest. Front cover 34 is attached to circular mounting body 32 by any suitable attachment means such a glue, threads, etc. Front cover 34 may be formed from any suitable material as mentioned above even a hard plastic, metal, etc. However, in preferred embodiments, the material is made from a flexible material so as not to interfere with the projectile being shot from the pouch.

For example, when an arrow is being shot from the pouch, you do not want the cover material on front cover 34 to interfere with the fletching of the arrow. Furthermore, if a pellet is being shot from the pouch and it is not traveling straight through the round opening in the cover, you also do not want front cover 34 to interfere with the trajectory of the pellet. In various embodiments, when shooting a pellet, the user may want to remove the cover so that it does not interfere with the flight of a pellet.

An arrow carrying system 36 may be mounted to first end 14A of elongated rail 14 and second end 14B of elongated rail 14 by suitable coupling means such as glue, weldments, attachments, etc. The arrow carrying system may be configured to carry one or more arrows 38. In various embodiments, the arrow carrying system 36 may be mounted on one or both sides of the elongated rail 14.

Stock 12 contains a trigger mechanism 40 and a hook 42 that is operatively coupled to trigger mechanism 40. A safety device 46 is operatively coupled to trigger mechanism 40 to prevent the trigger from being inadvertently pulled when the user is not ready to shoot the sling shot gun. A blow back plate 48 is mounted to the back of stock 12 to prevent accidental blow back of any debris into the user's eyes. In various embodiments, blow back plate 48 may be made from any suitable material. In preferred embodiments, blow back plate 48 is made of a clear polymer to allow the user to see where they are aiming the sling shot gun. In various embodiments, the blow back plate contains a vertical slot 48A that allows the user to have a clear line of vision to a sighting mechanism 44. In some embodiments, sighting mechanism 44 can be a standard sighting mechanism, a laser sight, a lighted dot sight or any other suitable sighting mechanism.

Stock

Referring to FIG. 2, stock 12 may be formed from any suitable material such as s polymer, a metal, a metal alloy, etc. and comprises a handle 12A. Handle 12A in various embodiments may comprise a hollow cavity 12B that is configured to removably receive a magazine (e.g., storage compartment) configured to hold one or more pellets (e.g., round balls, slugs, etc.) or any other material the user wishes to carry. Stock 12 is also configured to receive trigger 40. Trigger 40 comprises an elongated lever having a first end 40A configured to receive input from the user, a second end 40B that is configured to engage with the hook 42. Hook 42 may be formed in various configurations, and in preferred embodiments, hook 42 is formed from a generally circular body 42A that is operatively held in stock 12 by a pin 42*b*. Generally circular body 42A is operatively engaged with second end 40B of trigger 40. A spring 42C is operatively positioned between stock 12 and generally circular body 42A and biases the hook 42 into the vertical position as shown in FIG. 2.

Stock 12 also houses a safety button 46 (FIGS. 1& 2) that is operatively engaged with a safety pin 46A. A spring 46B is operatively positioned between an end of pin 46A and stock 12 and is configured to bias pin 46A toward elongated rail first end 14A. In operation, if safety button 46 (FIGS. 1 and 2) is not pushed, pin 46A blocks trigger lever first end 40A from being puller rearward. When safety button 46 is depressed, trigger first end 46A can be pulled rearward against bias of spring 46B thereby disengaging trigger second end 40B from hook cylindrical body 42A.

Grip

Still referring to FIG. 2, grip 18 comprises a grip body 18A, a generally cylindrical body 18B and a trigger 18C. Generally cylindrical body 18B is slidably mounted on elongated rail 14 intermediate elongated rail first end 14A and second end 14B. Trigger 18C is rotatably coupled to grip body 18A by a pin 18F. A spring 18E is positioned between grip body 18A and trigger 18C. An insert 18D is received in a cavity (not labeled) in trigger 18C such that when the trigger 18C is not squeezed, spring 18E biases trigger 18C forward away from grip body 18 so that insert 18D does not engage with elongated rail 14. Insert 18D may be made from any suitable material such as a polymer, elastomer, rubber, or any other suitable material that causes a frictional grip when trigger 18C is squeezed toward grip body 18A thereby causing insert 18D to engage with elongated rail 14.

Generally Cylindrical Body

Generally cylindrical body 22 comprises a first portion 22A that extends from a generally cylindrical second portion 22B and a third portion 22C that extends from the second portion 22B. In various embodiments, first, second and third portions 22A, 22B and 22C may be formed from two separate parts that are coupled together. In other embodiments, first, second and third portions 22A, 22B and 22C may be integrally formed from any suitable material (e.g., polymers, metals, etc.). Generally cylindrical body 22 further comprises a pin 22D that is received in a cavity (not numbered) formed in first portion 22A. Pin 22D is surrounded by a spring 22F that is positioned around pin 22D and radially inwardly biased toward elongated rail 14. Generally cylindrical body 22 is configured to be slidably received on elongated rail 14 and can slide between elongated rail first end 14A and second end 14B. In various embodiments, pin 22D is configured to be received in at least one opening 14C formed in elongated rail 14 so that generally cylindrical body 22 can be secured at the at least one particular location on elongated rail 14. Generally cylindrical body third portion 22C is configured to be mounted to resiliently stretchable launch mechanism 20 as explained in more detail below. In various embodiments, it should be understood that generally cylindrical body 22 may be formed without pin 22D.

Resiliently Stretchable Launch Mechanism

Figure 3:
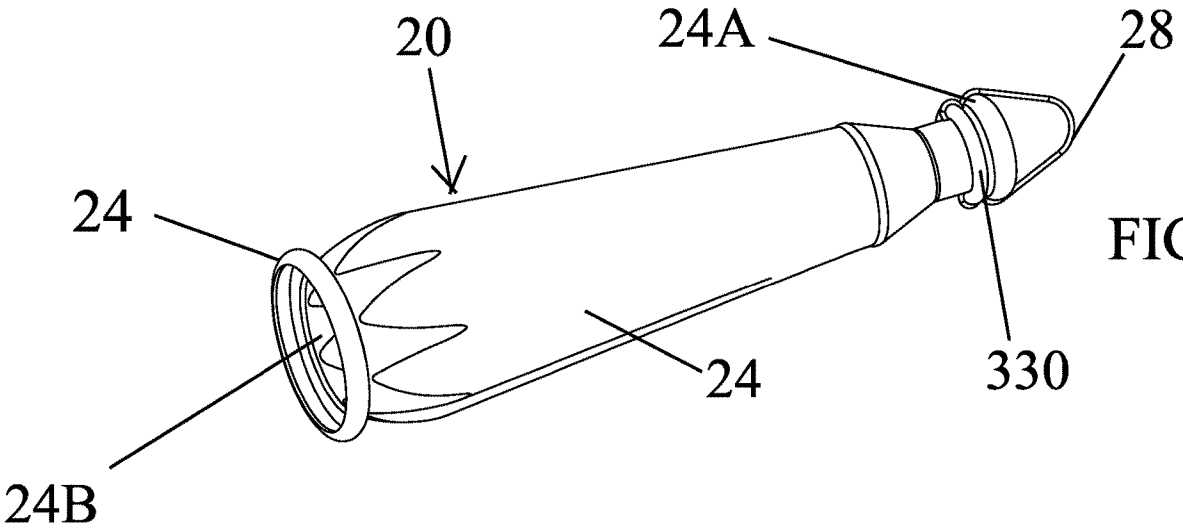
FIG. 3 is a perspective view of the resiliently stretchable pouch of the sling shot rifle of FIG. 1.

Referring to FIG. 3, resiliently stretchable launch mechanism 20 comprises the resiliently stretchable pouch 24. Resiliently stretchable pouch 24 may be formed from any stretchable material such as a stretchable polymer, elastomer, rubber, latex, etc. or any other suitably stretchable compound. In various embodiments, resiliently stretchable pouch 24 comprises a closed first end 24A and an open second end 24B. Closed first end 24A may be reinforced (e.g., formed from thicker walls, reinforced with a laminate material, etc.) to strengthen the material. Second open end 24B may be formed with a uniform thickness similar to the center portion of the pouch or it may be formed with a thicker wall or lip portion 24C (FIG. 3). Resiliently stretchable pouch second end 24B is operatively coupled to generally cylindrical body third portion 22C by circular mounting body 32.

In some embodiments, resiliently stretchable pouch second end 24B may be glued to circular mounting body 32 (FIG. 2), pinch fit between circular mounting body 32 and a ring 32A (FIG. 2) that is press fit into, threaded on circular mounting body 32, or secured in any other suitable fashion that securely couples resiliently stretchable pouch second end 24B to circular mounting body 32. In various embodiments, generally cylindrical body third portion 22C and circular mounting body 32 are formed as separate parts. In other embodiments, generally cylindrical body third portion 22C and circular mounting body 32 are integrally formed. In various embodiments, resiliently stretchable pouch 24 is elongated in length and in some embodiments, it may be tapered in diameter between resiliently stretchable pouch first end 24A and resiliently stretchable pouch second end 24B. In some embodiments, the diameter at first end 24A is smaller than the diameter of second end 24B.

In operation, the closer generally cylindrical body 22 is fixed to elongated rail second end 14B, the more force will be exerted on a projectile shot from resiliently stretchable pouch second end 24B when resiliently stretchable pouch first end 24A is released from the catch 42. Thus, when shooting close targets or small varmint, generally cylindrical body 22 may be fixed at a position more distal from the resiliently stretchable pouch second end 24B.

Improved Resiliently Stretchable Launch Mechanism

Referring to FIG. 3, resiliently stretchable launch mechanism 20 is formed from a stretchable pouch 24 having an inner surface and an outer surface. Stretchable pouch 24 has a closed first end 24A, an open second 24B and a lip 24C. Lip 24C may be formed from curved material or it may be formed as a circular bead. In either case, lip 24C is configured to be received by a mounting ring 32 (FIG. 2).

Figure 4:
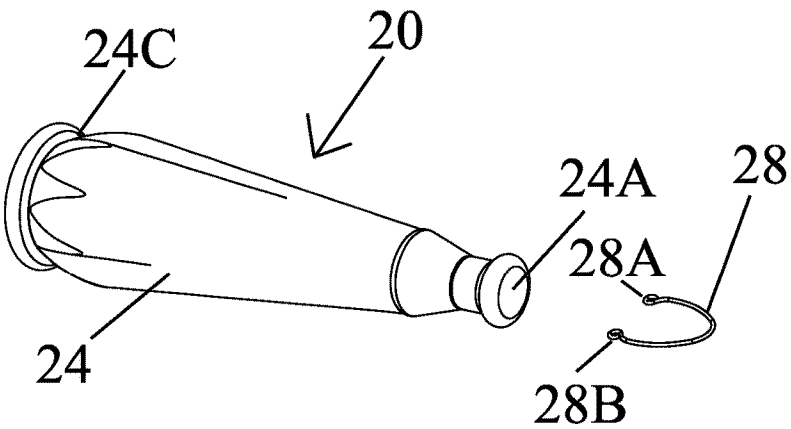
FIG. 4 is an exploded view of the resiliently stretchable pouch of FIG. 3.
Figure 4A:
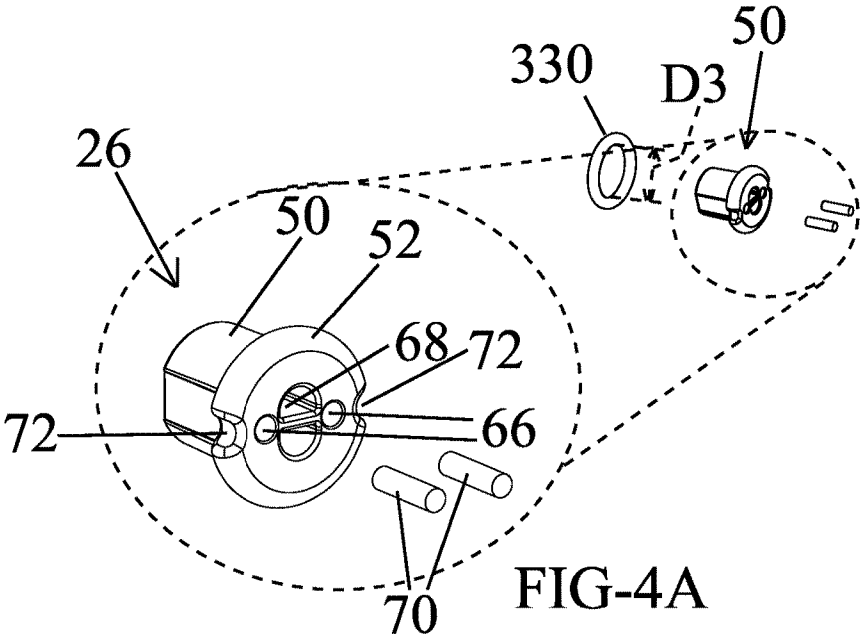
FIG. 4A is a zoomed in perspective view of the insert from the resiliently stretchable pouch of FIG. 4.

Referring to FIGS. 3, 4 and 4A, an insert 26 configured to be received in stretchable pouch closed first end 24A. In particular, insert 26 is placed into open second end 24B of the pouch and moved into closed first end 24A. Once seated, ring 30 is slide over the outside of open second end 24B of the pouch and seated over insert 26. Loop 28 is positioned so that it extends rearward of closed pouch first end 24A. Ends 28A and 28B of loop 28 are attached to opposite sides of ring 30 by any suitable means such as weldments, glue, fasteners, or by wrapping and twisting the ends to the wire around itself or tying two ends of a cord around ring 30.

Figure 8:
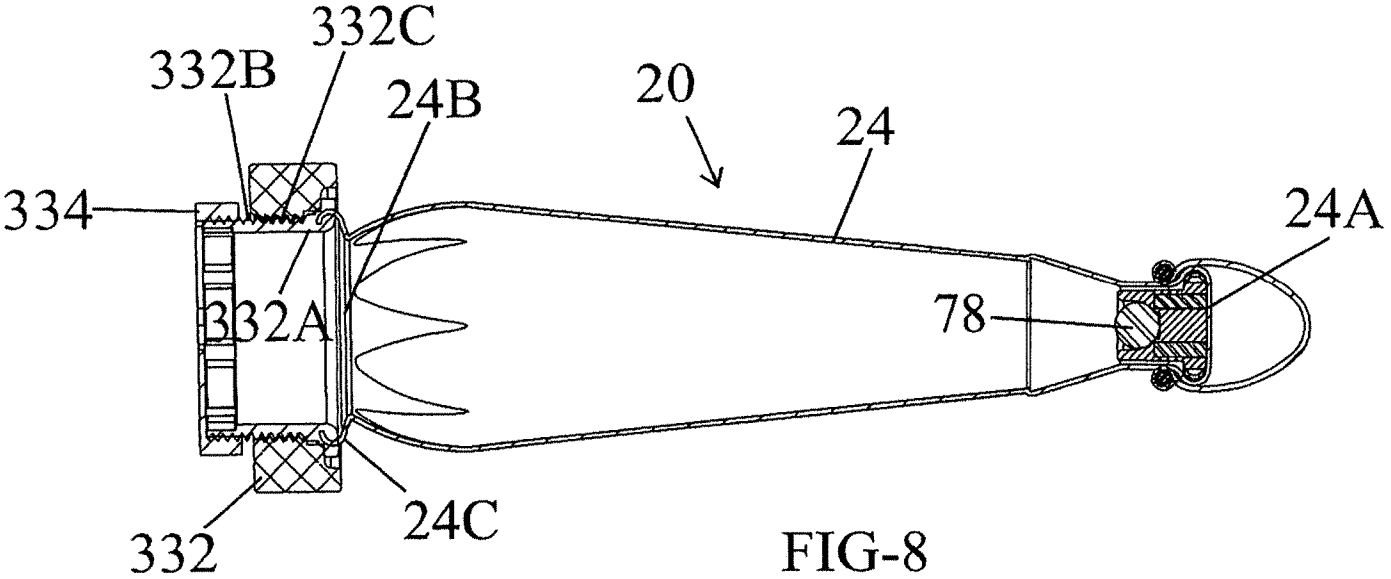
FIG. 8 is a sectional view of another embodiment of the resiliently stretchable pouch for use in the sling shot rifle of FIG. 1.

Referring now to FIGS. 5A, 5B, 6 and 7 insert 26 comprises an insert first body 50 and an insert second body 52. Insert first body 52 has a first end 54, a second end 56, a first length 58, and a first diameter D1. In various embodiments, an axial cavity 56A extends inward from first body second end 56 and contains a curved base 56B. Curved base 56B is configured to seat a round pellet 78 (FIG. 8). Insert second body 52 also comprises a first end 60, a second end 62, a second length 64, and a second diameter D2. In various embodiments, insert first body 50 may be generally cylindrical in shape, and insert second body 52 may also be cylindrical in shape.

In some embodiments, insert first body first length 58 is longer than insert second body second length 64. In other embodiments, the insert first body length 58 many shorter than the insert second body second length, and in still other embodiments, the two lengths may be substantially the same (i.e., equal lengths). In some embodiments, insert first body 50 and insert second body 52 are separately formed and coupled together using a suitable coupling such as weldments, glue, fasteners, etc. In other embodiments, insert first body 50 and insert second body 52 are made from a suitable material such as polymer, rubber, elastomer, etc. and are integrally formed together. In various embodiments, insert first body first diameter D1 is smaller than insert second body second diameter D2. Accordingly, in these embodiments, insert second body 52 functions as a flange that ring 30 seats against.

Figure 5B:
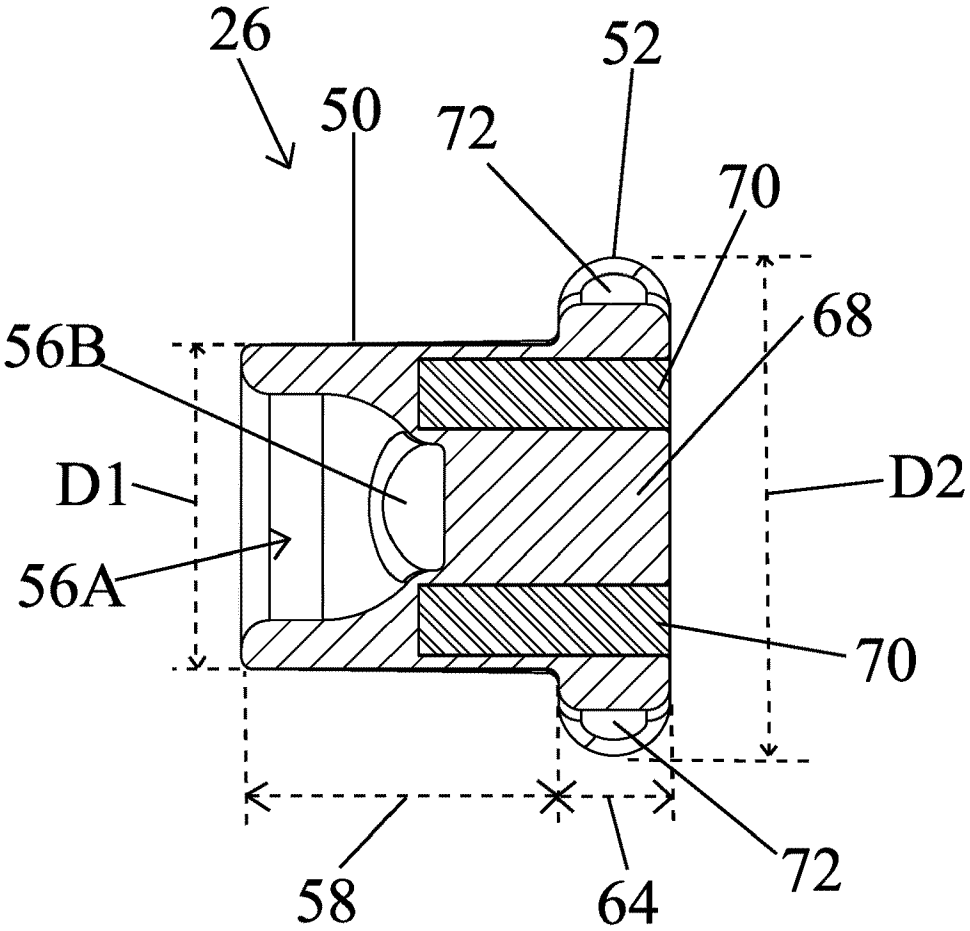
FIGS. 5A and 5B are sectional views of the insert shown in FIG. 4A, where the sectional view of FIG. 5B is taken through the insert 90 degrees rotated from the insert position shown in FIG. 5A.

In various embodiments, one or more cavities 66 (FIG. 4A) may be formed through insert first body 50 and insert second body 52. One or more magnets 70 are configured to be placed in a respective one of the one or more cavities 66 so that the ends of the one or more magnets 70 are configured to retain round pellet 78 (FIG. 8) in the curved base 56B. Said another way, the ends of one or more magnets 70 are positioned proximate to curved base 56B (as shown in FIG. 5B) thereby magnetically retaining a pellet in curved base 56B. In some embodiments, a pin or tab 68 may be formed in insert 26 such that the tab is accessible from the rear of axial cavity 56A proximate to curved base 56B. Tab 68 is configured to receive the nock arrow. It should be understood that other structure for retaining the pellet in the insert are within the scope of the present invention. For example, the insert radial cavity 56A may contain additional material such as a rubber or elastomer material that is configured to releasably retain the pellet in the cavity.

In various embodiments, insert second body 52 may also contain two recesses 72 formed in an outer surface of insert second body 52 on opposite sides of insert second body 52 (FIG. 5B). Recesses 72 are configured to provide space for loop 28 first end 28A and second end 28B to attach to ring 30 as shown in FIG. 3. In this way, the recesses help prevent loop 28 from digging into pouch 24. Another reason to have recesses 72 is to rotationally retain ring 30 in its proper position and to prevent it from rotating around the insert.

In various embodiments, insert first body first diameter D1 may vary along the length of insert first body 50 between insert body first end 54 and insert body second end 56 so that first diameter D1 at insert body first end 54 is larger than first diameter D1 at insert first body second end 56. In these embodiments, when ring 30 is slipped over the outer surface of resilient stretchable pouch 24 and over insert first body 50, ring 30 will wedge against an insert first body outer surface as it approaches and abuts against insert second body second end 62.

Referring to FIG. 8, resiliently stretchable launch mechanism 20 is shown coupled to circular mounting body 32 and ring 32A from FIG. 2. Ring 32A has a thread 32B formed on an outer surface. In some embodiments, ring 32A is threaded into mounting body 32 as shown in FIG. 8. In this configuration, stretchable pouch lip 24C is press fit between mounting body 32 and ring 32A. A cover 34 like the one described in FIGS. 1 and 2, is coupled to an end of ring 32A. In other embodiments, ring 32A may be press fitted into mounting body 32 instead of threadedly coupled thereto.

Figure 9B:
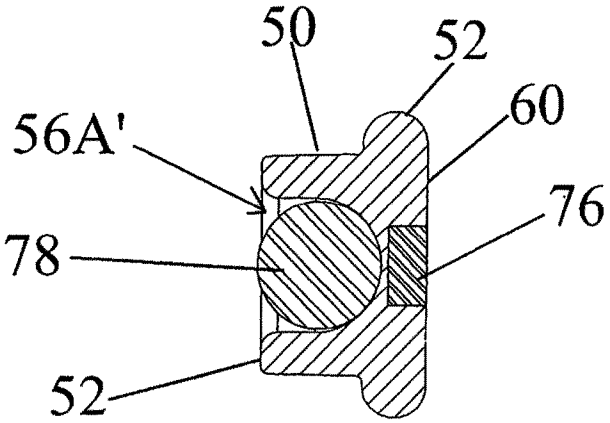
FIGS. 9A and 9B are another embodiment of an insert for use in the resiliently stretchable pouch of FIGS. 6, 7 & 8, where
Figure 9A:
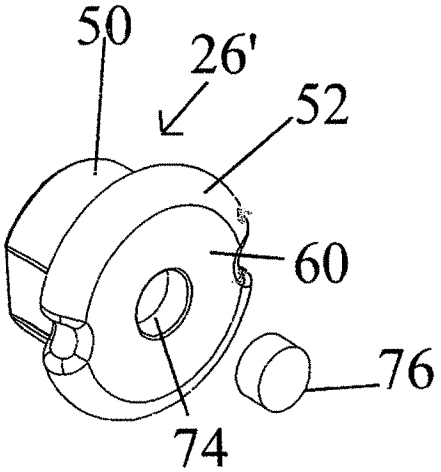

Referring to FIGS. 9A and 9B, a second embodiment of an insert 26' like the insert of FIGS. 4A-8 has a first body 50 and a second body 52. For purposes of discussion, the description associated with FIGS. 4A, 5A and 5B apply to insert 26'. As such and for brevity, only the differences associated with insert 26' will be discussed herein. Insert 26' has a blind cavity 74 formed in insert second body first end that is configured to seat a magnet 76 therein. A cavity 56A' is formed in insert first body second end 52 and is configured to receive round pellet 78. Magnet 76 is configured to releasably retain round pellet 78 in cavity 56A. In this second embodiment, insert 26' is only configured to receive and shoot a pellet (e.g., round ball, slug, etc.) and can also shoot an arrow that has a small steel nock since the magnet will retain the steel nock in the cavity.

Operation of the Sling Shot Rifle

Figure 10A:
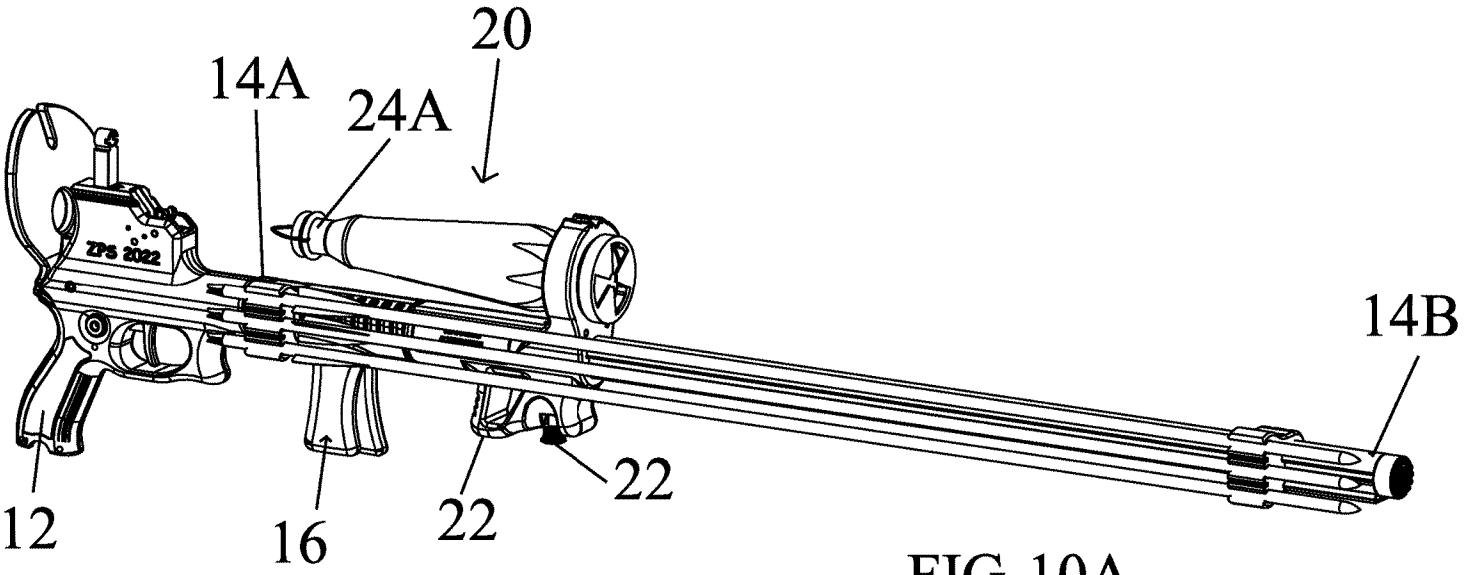
FIG. 10A is a perspective view of the sling shot rifle of FIG. 1 with the resiliently stretchable pouch moved from an initial position shown in FIG. 1 to a second position shown in FIG. 10A.
Figure 10B:
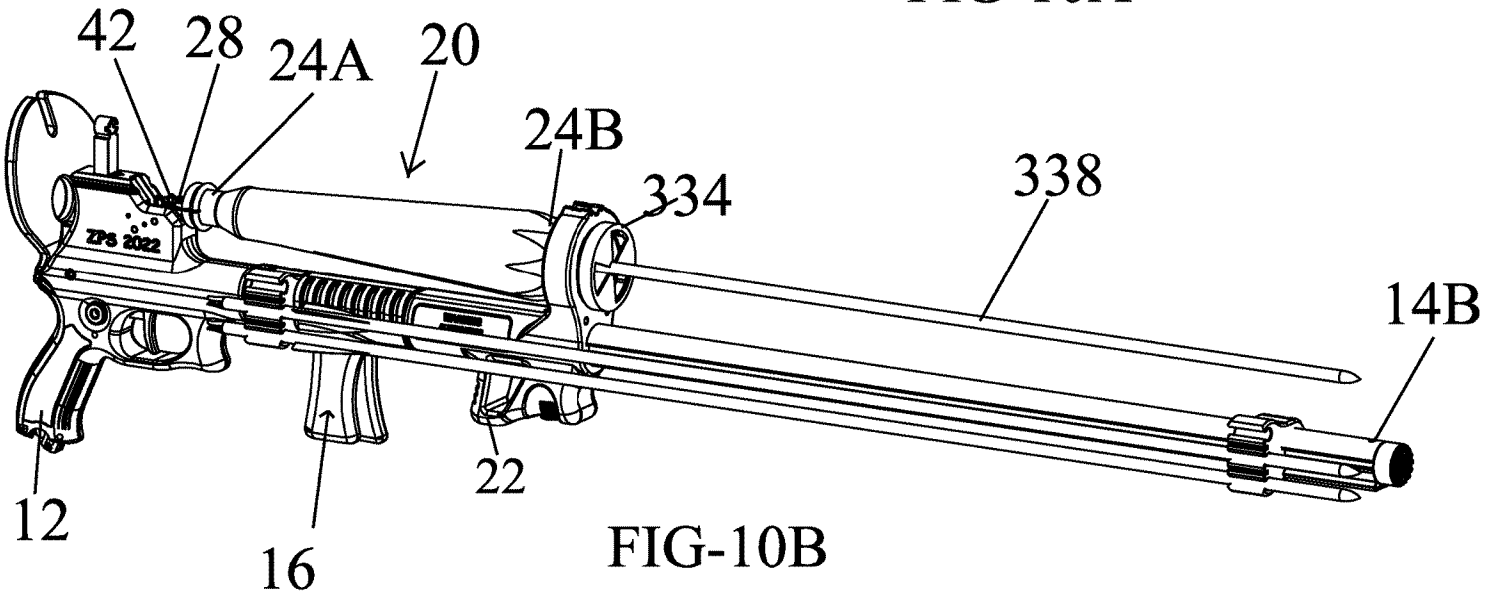
FIG. 10B is a perspective view of the sling shot rifle of FIG. 10A with the rear end of the resiliently stretchable pouch attached to a trigger mechanism and an arrow loaded into the resilient stretchable pouch.

Referring to FIGS. 10A-10D, in operation of the sling shot rifle, FIG. 10A shows slide grip 16 and generally cylindrical body 22 moved rearward in a first position proximate elongated rail first end 14A. Generally cylindrical body 22 is moved by the user by pulling pin head 22E downward thereby disengaging pin 22D (FIG. 2) from elongated rail 14 proximate the elongated rail second end 14B. Referring to FIG. 10B, once the generally cylindrical body 22 is in the first position, the user than grasps stretchable pouch closed first end 24A and insert 26 and pulls the loop 28 toward catch 42 until the loop is releasably engaged with catch 42. Once this step is complete and the sling shot rifle is in the second position, the user may then load an arrow 38 into the pouch open end 24 through cover 34 until the back end of the arrow is nocked on tab 68 (FIG. 6) in insert 26. Cover 34 functions as an arrow rest thereby aligning the arrow flight with sight 44.

Figure 10C:
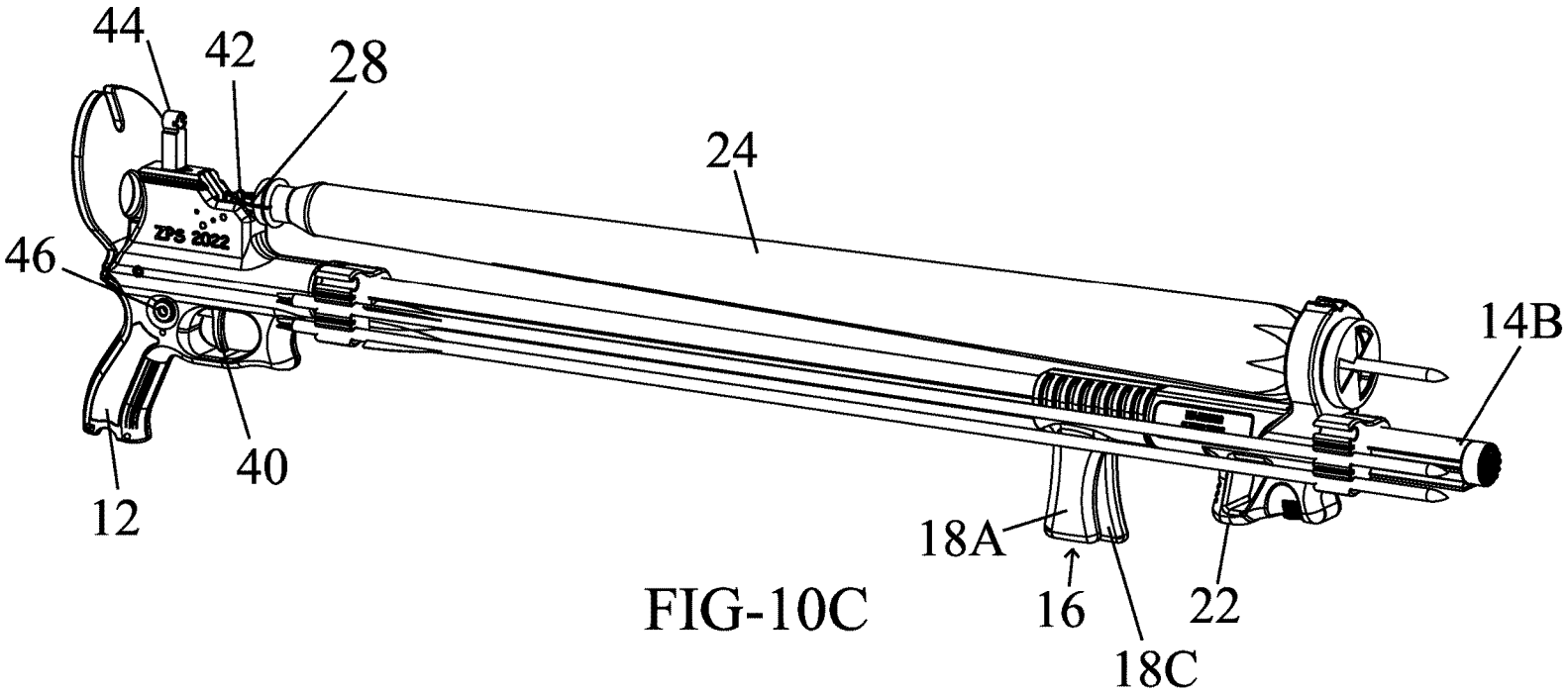
FIG. 10C is a perspective view of the sling shot rifle of FIG. 10B with the open second end of the resiliently stretchable pouch moved to a third position with the generally cylindrical body locked in place so that the pouch is in a fully stretched position.

To cock the sling shot rifle, and referring to FIG. 10C, the user holds grip 12 with one hand while grasping slide grip 16 being careful not to squeeze grip body 18A and grip trigger 18C together so as not to fix slide grip 16 to elongated rail 14. The user than pushes slide grip 16 forward out of the second position thereby pushing generally cylindrical body 22 forward until the pin 22D (FIG. 2) engages with at least one opening 14C in elongated rail 14 in to a cocked third position. Once pin 22D engages with the at least one opening 14C, stretchable pouch 24 will be in a fully loaded third position. Said another way, stretchable pouch 24 will be fully extended and ready to fire arrow 38 or another projectile loaded in insert 26 such as a round pellet ball, slug, etc. Comparing FIGS. 10B and 10C, as pouch open second end 24B is moved forward toward elongated rail second end 14B, the arrow body is pulled into stretched stretchable pouch 24.

Figure 10D:
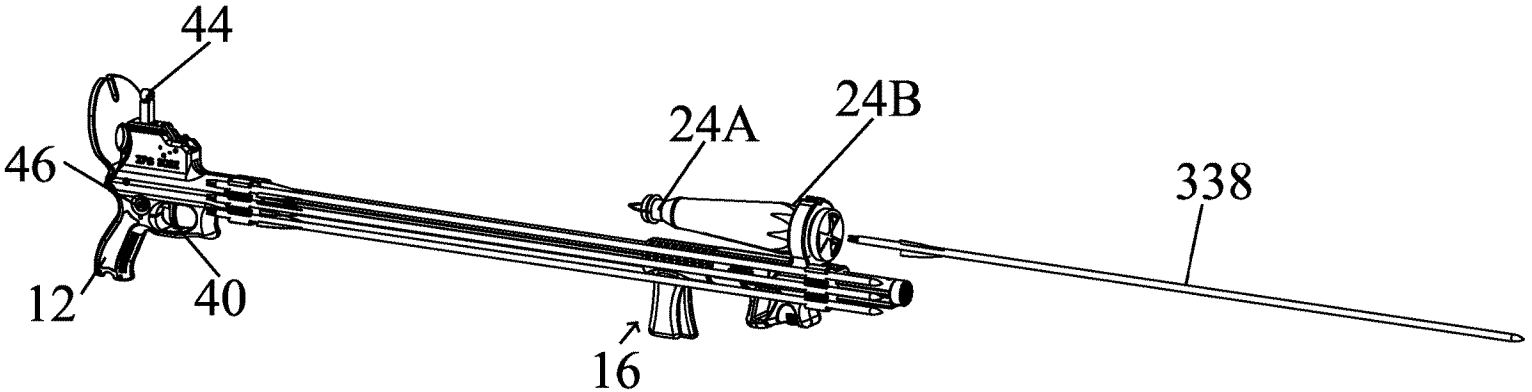
FIG. 10D is a perspective view of the sling shot rifle of FIG. 10C just after the trigger is pulled and the rear end of the resilient stretchable pouch returns to the initial position thereby ejecting the arrow from the pouch.

Referring to FIGS. 10C and 10D, once the sling shot rifle is cocked and in the third position as shown in FIG. 10C, the user can move slidable grip 16 to any comfortable position since generally cylindrical body 22 is locked in place. Once the user moves slidable grip 16 into a comfortable position, the user can squeeze grip body 18A and grip trigger 18C thereby causing the slidable grip to become frictionally fixed to elongated rail 14. The user may then aim the sling shot rifle using sight 44. When the user is ready to fire the arrow, the user depresses safety button 46 allowing trigger 40 to be pulled rearward toward grip 12. Once safety button 46 is depressed, the user can pull trigger 40 causing catch 42 to be released. As catch 42 is released, it can rotate allowing loop 28 to be released. Stretchable pouch closed first end 24A snaps forward as stretchable pouch 24 unstretches and returns to its unstretched state as shown in FIG. 10D causing the arrow 38 to be catapulted forward. When the arrow or other projectile is fired, the sling shot rifle returns to its initial position shown in FIG. 1.

In various embodiments, the locking pin system of generally cylindrical body 22 may be removed and instead of the pin locking generally cylindrical body 22 in the third position, the user instead retains the generally cylindrical body 22 in the third position using slidable grip 16 by squeezing the grip trigger 18C with the grip body thereby causing the slidable grip 16 to be frictionally locked to the elongated rail 14. In this configuration, the user must maintain the slingshot rifle in the third cocked position with the slidable grip or generally cylindrical body 22 will naturally return to the second position as a safety feature.

Alternate Embodiments

Figure 11:
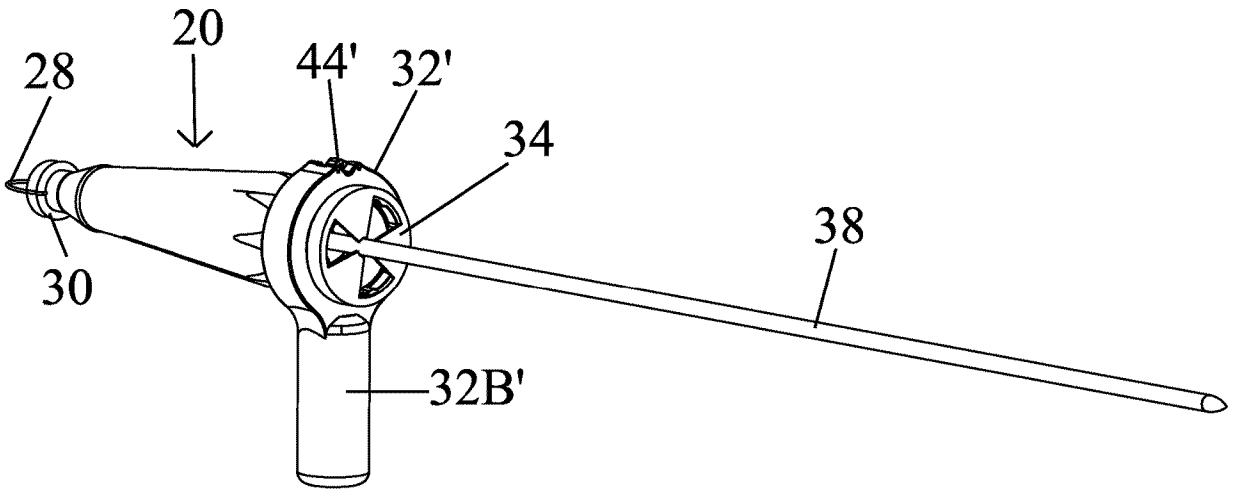
FIG. 11 is perspective view of another embodiment of a handheld slingshot using the resiliently stretchable pouch of FIG. 3
Figure 12:
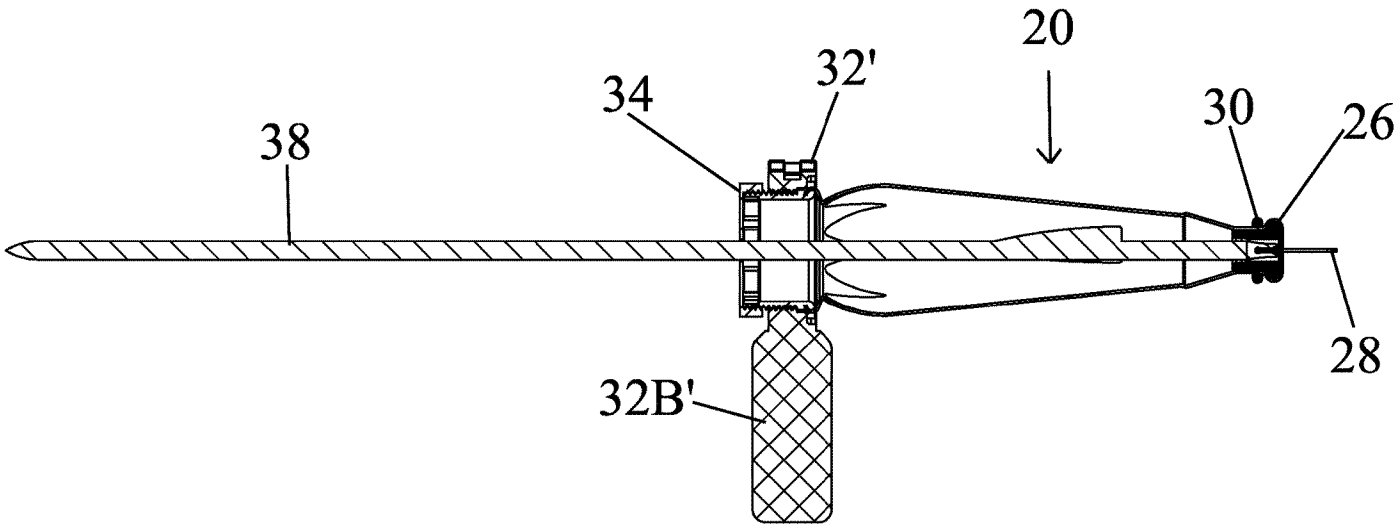
FIG. 12 is sectional view of the slingshot of FIG. 11 with an arrow nocked in the insert.

Referring to FIGS. 11 and 12, an alternate embodiment of a handheld slingshot is shown using the resiliently stretchable pouch shown in FIGS. 3-7. In various embodiments, the circular ring 32' is mounted to a handle 32B'. In all other aspects, the resiliently stretchable pouch 20, insert 26 and ring 30 function the same as described in FIGS. 3-7. In the embodiment shown in FIGS. 11 and 12, the user holds handle 32B' with one hand and pulls back on loop 28 with the other hand thereby stretching the resiliently stretchable pouch. When the user wants to shoot a projectile (e.g., arrow 38 or a pellet), the user releases the loop 28. The user can aim the projectile using a mechanical sight 44'.

Figure 5A:
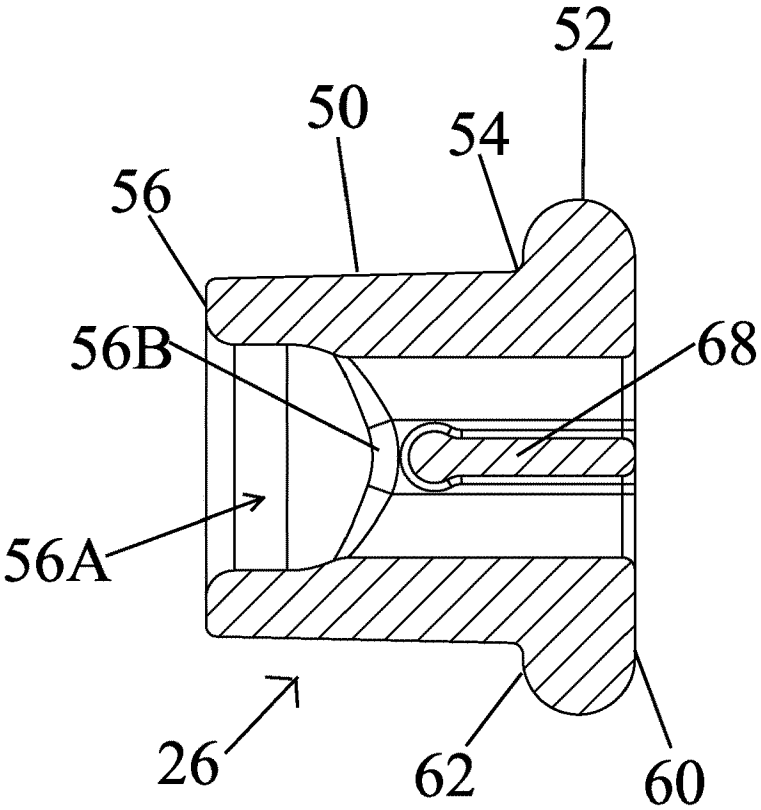
Figure 6:
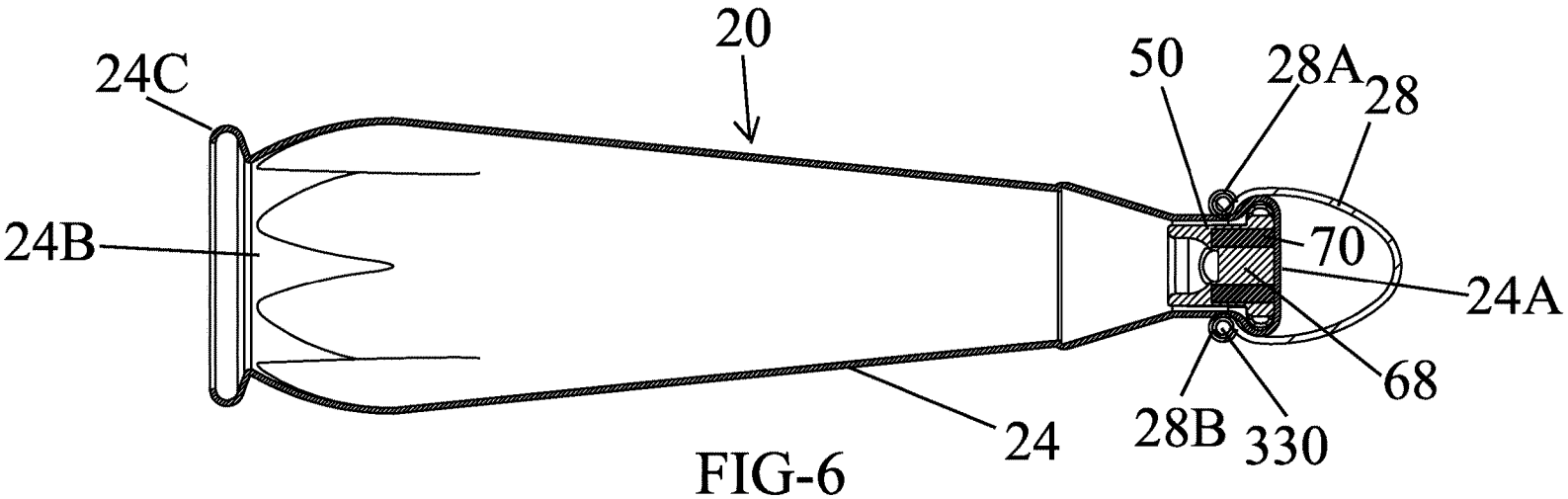
FIGS. 6 and 7 are sectional views of the resiliently stretchable pouch shown in FIG. 3, where the sectional view of FIG. 7 is taken through the resiliently stretchable pouch 90 degrees rotated from the resiliently stretchable pouch shown in FIG. 6.
Figure 7:
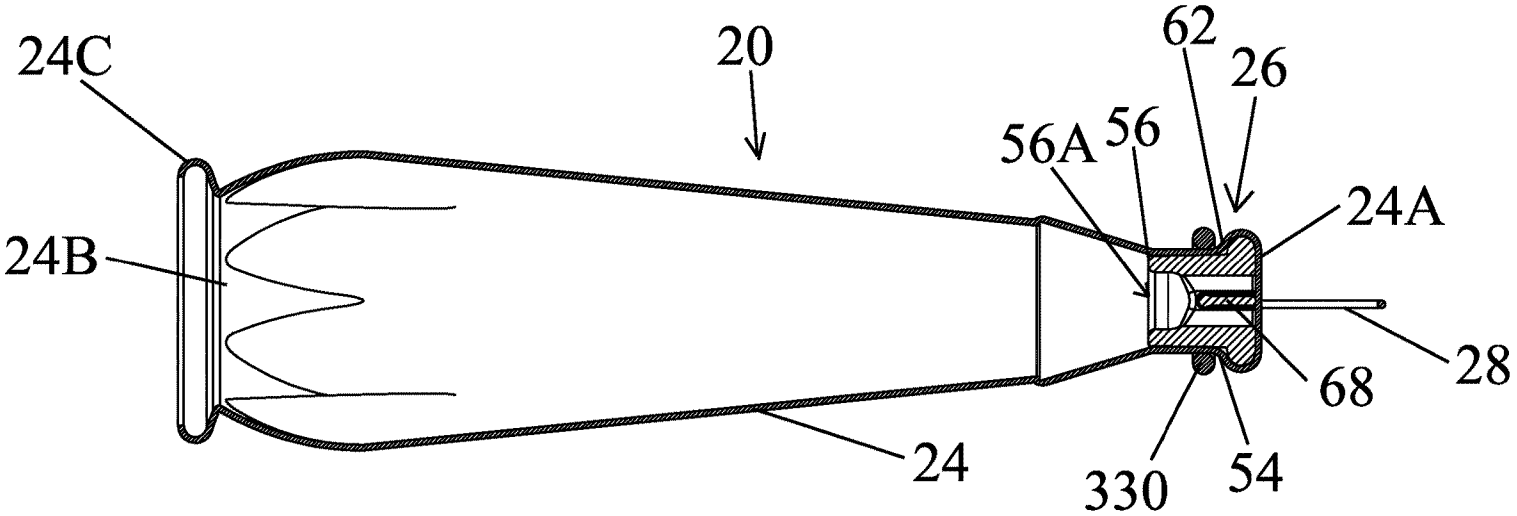
Figure 13A:
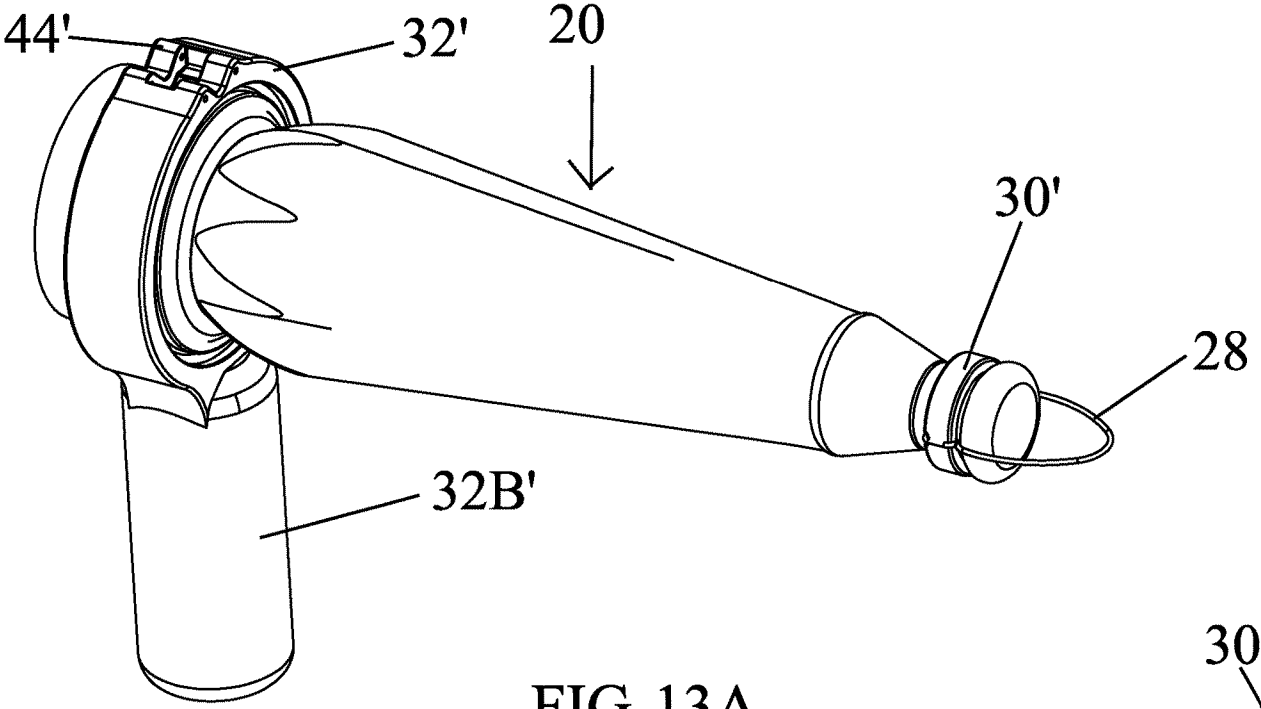
FIG. 13A is a perspective view of another embodiment of a resiliently stretchable pouch using a different embodiment of a cylindrical ring.
Figure 13B:
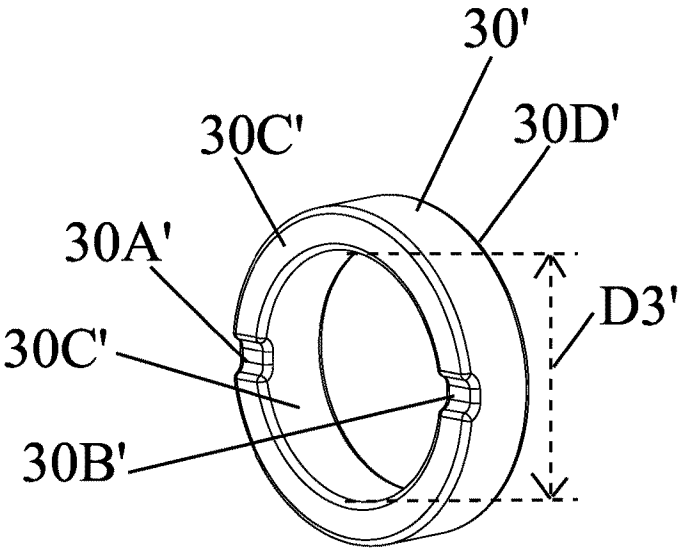
FIG. 13B is a perspective view of the cylindrical ring used with the resiliently stretchable pouch of FIG. 13A.

In yet another alternative embodiment mentioned above and shown in FIGS. 13A-13B, a generally flat cylindrical ring 30' (FIG. 13B) is shown for use with the resiliently stretchable pouch 20. As described earlier, an inner diameter D3' varies in length as across the surface so that the diameter at end 30C' is smaller than the diameter D3' at end 30D'. In this configuration, as ring 30' is slid over resiliently stretchable pouch 20 and seated on insert first body 50, the ring wedges onto the insert first body first end 54 adjacent insert second body second end 62 (FIG. 5A). This occurs because diameter D1 of insert first body also varies from insert first body first end 54 to insert first body second end 56 (FIG. 5A) where D1 at insert first body first end 54 is larger than D1 at insert first body second end 56. Ring recesses 30A' and 30B' allow the ends of loop 28 to be seated in the recesses when loop 28 is coupled to ring 30'. The configuration of ring 30' allows the ring to better seat around resilient stretchable pouch 20 on insert 26 minimizing any rocking by ring 30'.

Figure 14B:
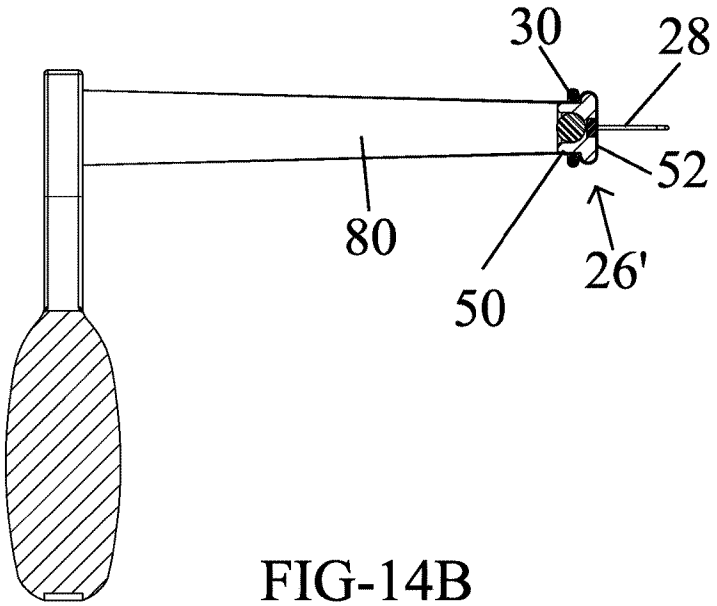
FIG. 14B is a cross sectional view of the slingshot of FIG. 14A.
Figure 14A:
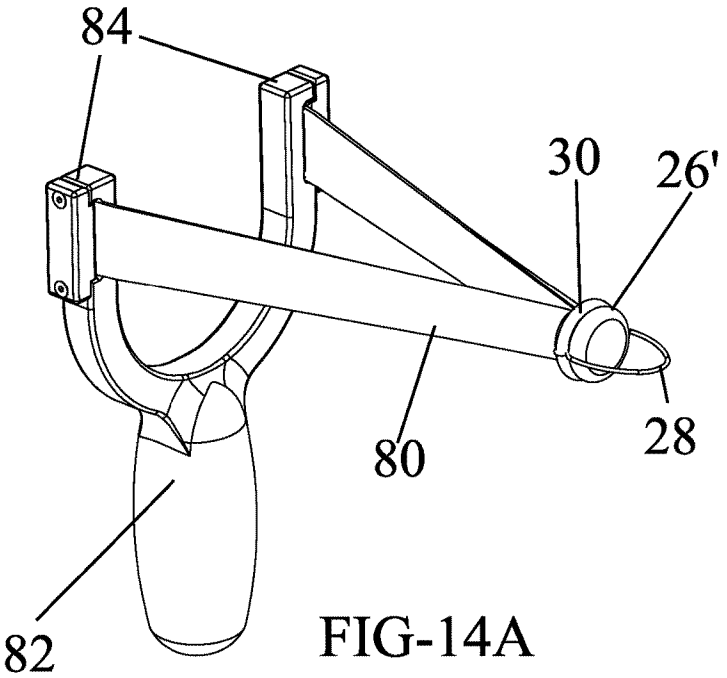
FIG. 14A is a perspective view of another embodiment of a slingshot.
Figure 14C:
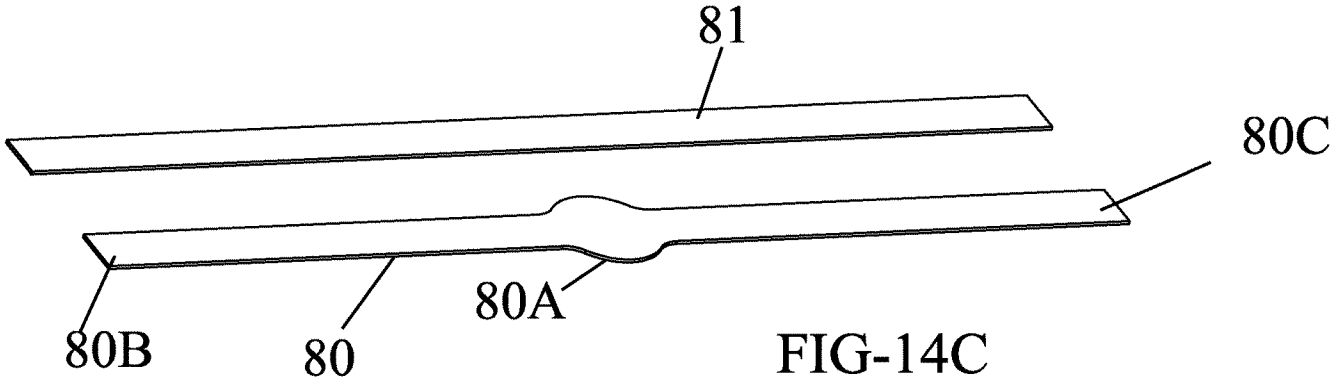
FIG. 14C are perspective views of resiliently stretchable bands for use in the slingshot of FIG. 14A or the slingshot rife of FIG. 1.

Finally, referring to FIGS. 14A-14C, another embodiment of a slingshot is shown where the resiliently stretchable pouch 20 of the previous FIGS. 11 and 12 are replaced with one or more of resiliently stretchable bands 80 and 81 or a combination of bands 80 and/or 81. In the embodiment disclosed, an insert 26' is seated on band 80 at a band insert section 80A. The first and second ends 80B and 80C are fed through ring 30 and ring 30 is moved down around insert first body 50 until it abuts with insert second body 52. The first and second ends of band 80 are then attached to respective sling shot arms 84 by any suitable means such as a press fitted connection, etc. Sling shot arms are coupled to a handle 84. In various embodiments, the slingshot arms 84 may be integrally formed with handle 84. The operation of the slingshot embodiment shown in FIGS. 14-14C is similar to the embodiment of the slingshot shown in FIGS. 11-12.

Figure 15A:
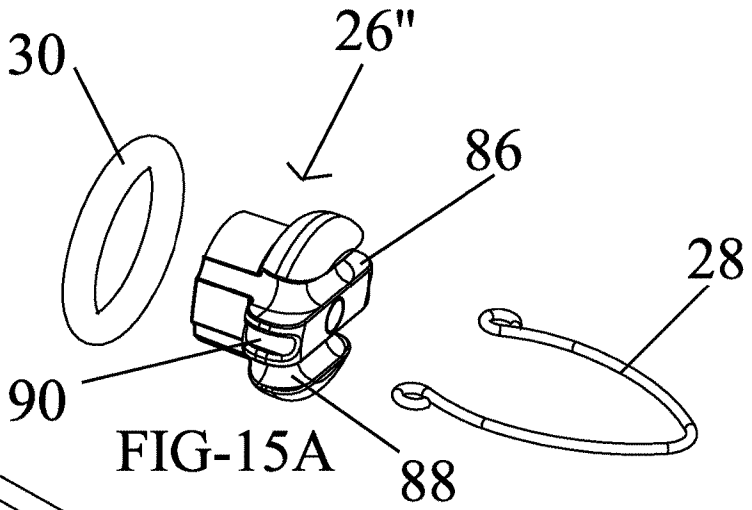
FIGS. 15 and 15A is a perspective view of another embodiment of an improved slingshot
Figure 15:
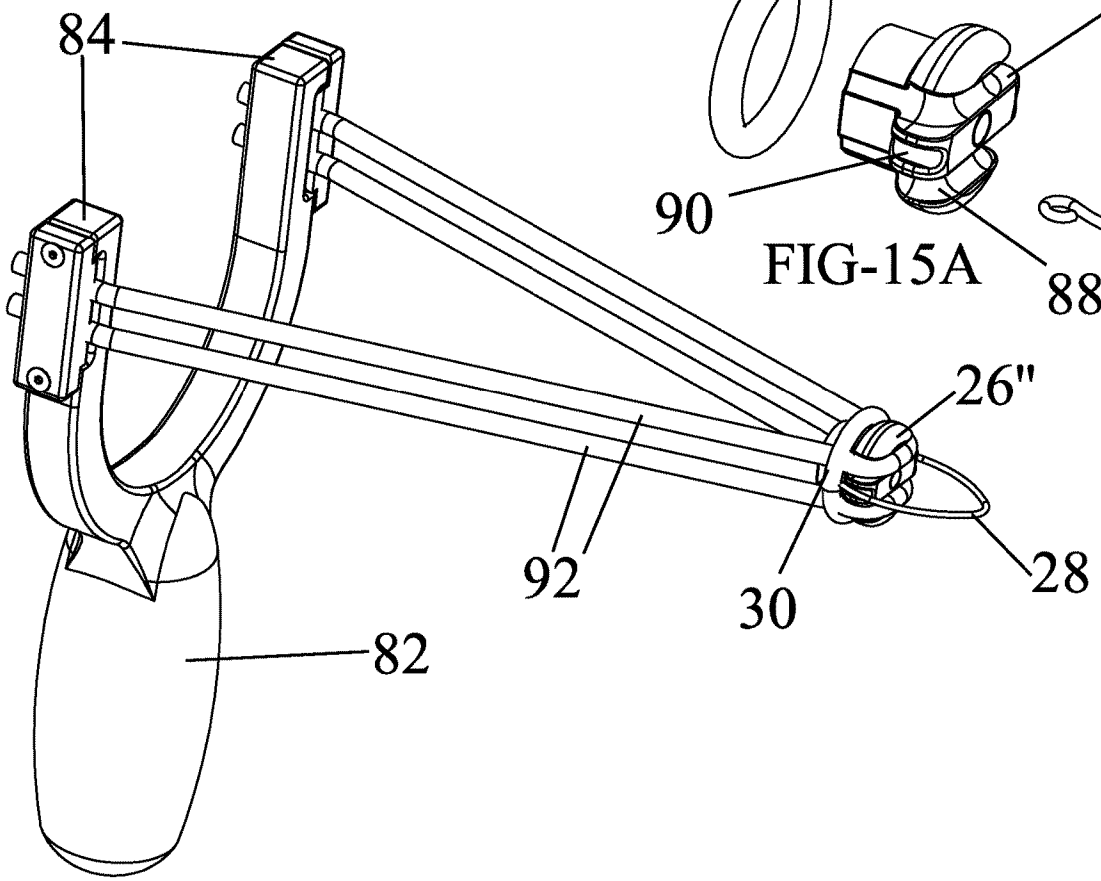

Referring to FIGS. 15 and 15A, another embodiment of the improved slingshot is shown where the resiliently material is at least one elongated resiliently stretchable tubing 92 is used with another embodiment of an insert 26". The insert 26" contains two recesses 86 and 88 that allow the at least one elongated resiliently stretchable tubing 92 to seat in insert 26". Ring 30 is received around the outside of the at least one elongated resiliently stretchable tubing 92 so that the ring seats on the insert first body adjacent the insert second body as shown in FIG. 15. Otherwise, the improved slingshot of FIGS. 15 and 15A is similar to that of FIGS. 14A—14C.

Figure 17:
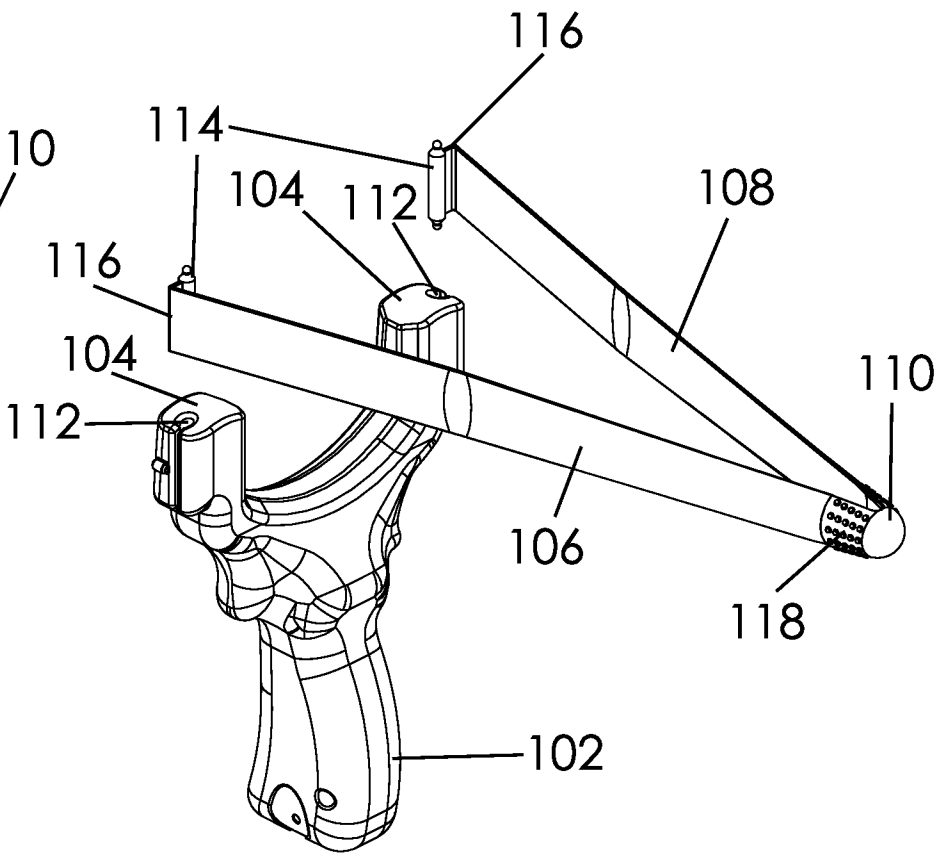
FIG. 17 is an exploded view of the improved slingshot of FIG. 16.
Figure 16:
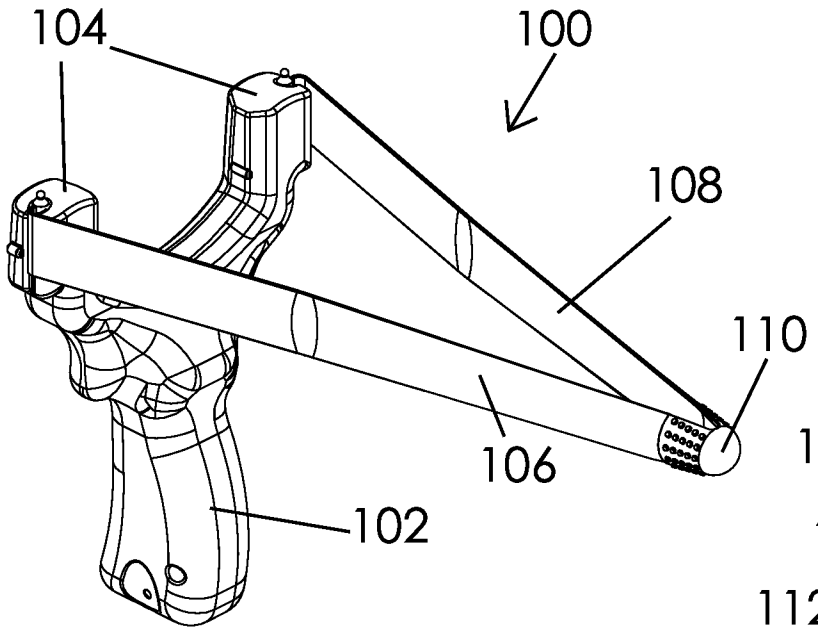
FIG. 16 is a perspective view of another embodiment of an improved slingshot.

Referring to FIG. 16, another embodiment of an improved slingshot 100 is shown having a handle grip 102 coupled to two arms 104. The sling is formed from a resiliently stretchable band having a first portion 106 and a second portion 108 that are each releasably coupled to a respective arm 104 of the grip 102. A pouch 110 is coupled to each respective resiliently stretchable band first portion 106 and a second portion 108. In various embodiments, pouch 110 is generally cupped in shape to allow a projectile to sit in the base of the pouch 110. In some preferred embodiments, the resiliently stretchable band first and second portions 106 and 108 are integrally formed with the pouch 110 and are all made from the same material. In some embodiments, a knurling 118 (FIG. 17) is formed on an outer surface of pouch 110 to allow a user to firmly grasp the pouch 110.

Figure 18:
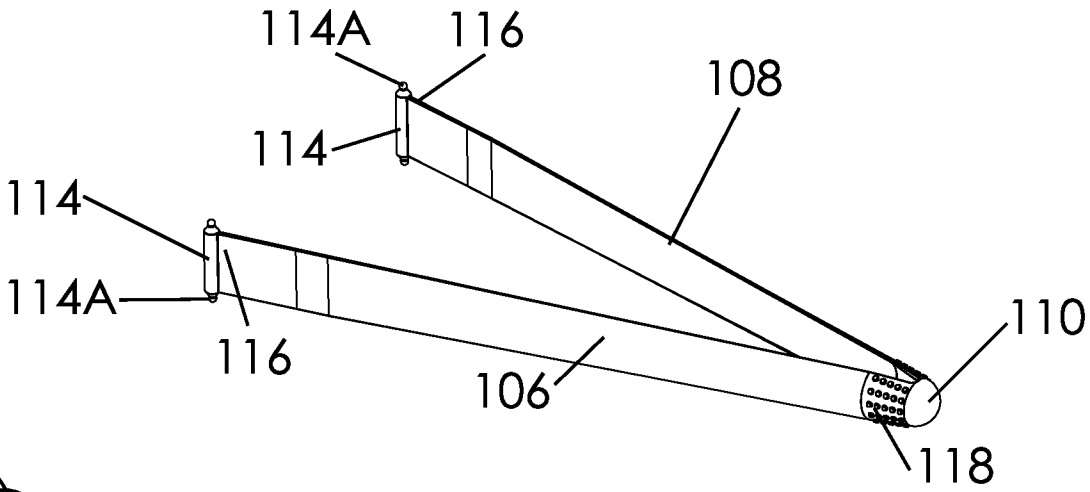
FIG. 18 is a perspective view of the resiliently stretchable band for use in the slingshot of FIG. 16.

Referring to FIG. 18, resiliently stretchable band first and second portions 106 and 108 terminate in a respective end 116 that comprises a mounting formation 114. Mounting formation 114 may be formed in various shapes such as a cylindrical body as shown in the figure, a flat mounting formation 114' (FIG. 21), a substantially cylindrical mounting formation 114", or any other suitable shape. It should be understood that the mounting formation 114, 114' or 114" may be in any suitably shape to allow resiliently stretchable band first and second portions 106 and 108 to be mounted to arms 104.

Still referring to FIG. 18, each mounting formation 114 also comprises ends 114A that may be formed on one or both ends of mounting formation 114. Ends 114A assist in retaining the resiliently stretchable band first and second portions 106 and 108 in arms 104. In various embodiments, mounting formations 114 are integrally formed with resiliently stretchable band first and second portions 106 and 108 and can be made from the same material as resiliently stretchable band first and second portions 106 and 108.

Figure 19:
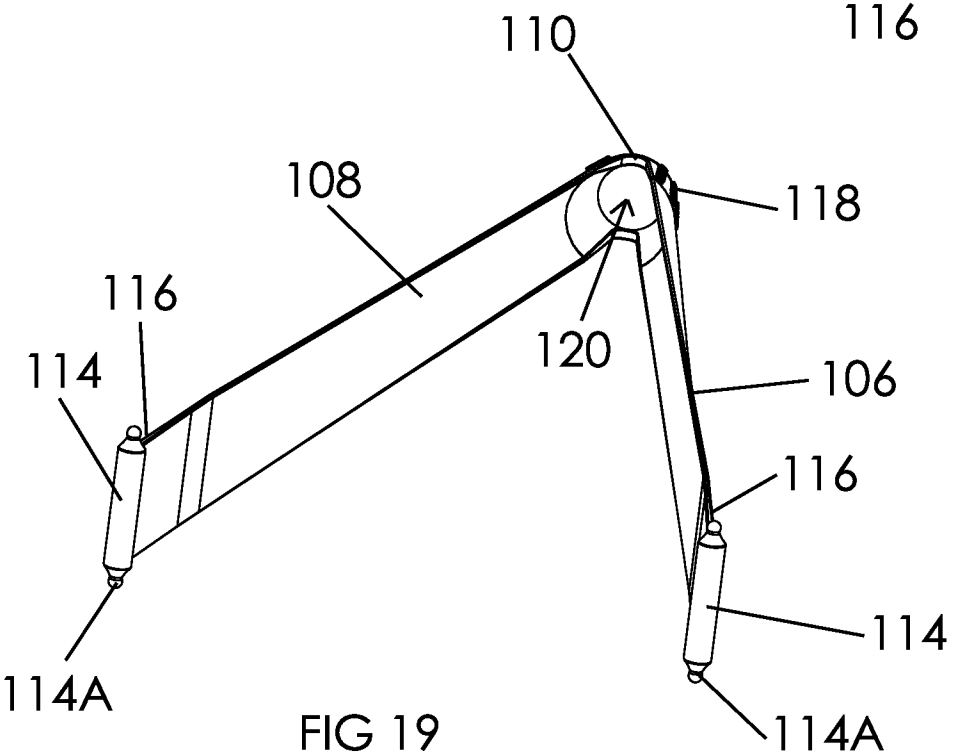
FIG. 19 is another perspective view of the resiliently stretchable band shown in FIG. 16.

Referring to FIG. 19, pouch 110 forms a cavity 120 therein that is shaped and sized to releasably retain a projectile therein. In various embodiments, pouch cavity can be sized and shaped to releasably retain a pellet, a slug, a round ball, etc. In various embodiments, pouch 120 may be sixed and shaped to releasably retain one or more different shaped projectiles. For example, in various embodiments, pouch cavity 120 may hold both pellets and arrows. In these embodiments, pouch 110 can have a first cavity portion that releasably retains a pellet and a second portion that releasably retains the knock end of an arrow.

In various embodiments, the resiliently stretchable band first and second portions 106 and 108 are formed from a rubber material. In other embodiments, resiliently stretchable band first and second portions 106 and 108 are formed from an elastomer material. In still other embodiments, resiliently stretchable band first and second portions 106 and 108 and pouch 110 may be formed from a blend of resiliently stretchable material (e.g., thermoplastic elastomers, rubber blends, etc.). In these and other embodiments described herein, the sling comprising the resiliently stretchable band first and second portions 106 and 108, mounting formations 114, ends 116 and pouch 110 are integrally formed together in a single unitary piece from the same material thereby forming a one-piece band and pouch sling. In various embodiments, the sling may be formed by rubber injection moldings, latex injection molding, using a dipped latex process, or by any other suitable manufacturing process for forming a one-piece integrally formed sling. However, it is contemplated that other forms of manufacture are possible where the resiliently stretchable band first and second portions 106 and 108 and pouch 110 are formed from a integral one-piece unit where the mounting formations 114 are attached to resiliently stretchable band first and second portions 106 and 108 at band ends 116.

Figure 21:
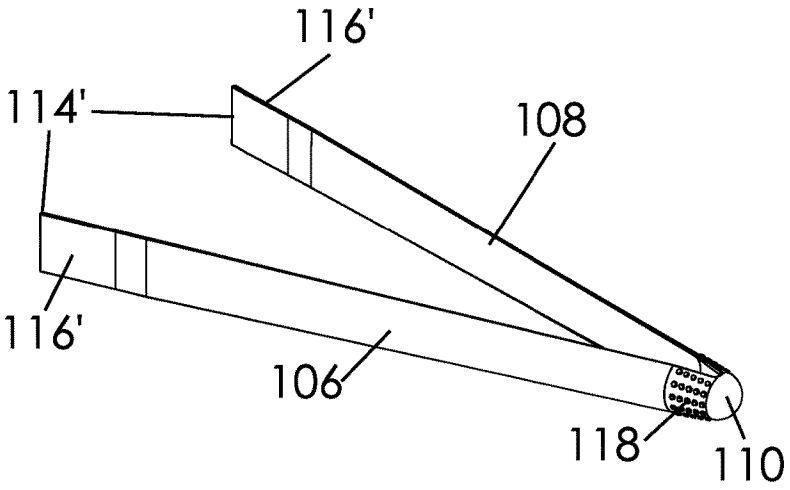
FIG. 21 is a perspective view of the resiliently stretchable band for use in the slingshot of FIG. 20.
Figure 20:
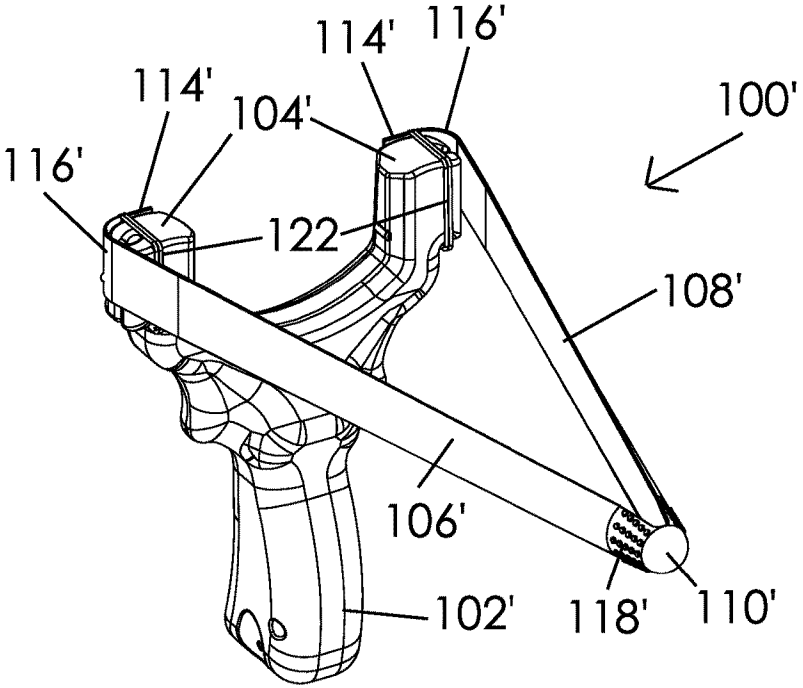
FIG. 20 is a perspective view of another embodiment of an improved slingshot.

Referring to FIGS. 20 and 21, an alternate embodiment of a slingshot. 100' is shown having similar structure to the slingshot 100 shown in FIGS. 16-19. The main difference in the structure of the slingshot 100' is in the mounting of resiliently stretchable band first and second portions 106 and 108 to arms 104'. In the embodiment shown, ends 116' comprise a flat mounting formation 114' that are each respectively secured to an arm 104' via a mounting clip 122'. Mounting clip 122' is formed from any suitable material such as metal, alloy, elastomer, or rubber material. In embodiments where mounting clip 122' is formed from an inflexible material such as metal or alloy, mounting clip 122' is sized and shaped to be releasably secured to arm 104 in a manner that secures a respective flat mounting formation 114' to a corresponding arm 104. Like the embodiments shown in FIGS. 16-19, the resiliently stretchable band first and second portions 106 and 108, ends 116', flat portions 114' and pouch 110' are all integrally formed from one piece of resiliently stretchable material. In this way, the entire resiliently stretchable material can be switched out quickly.

Figure 23:
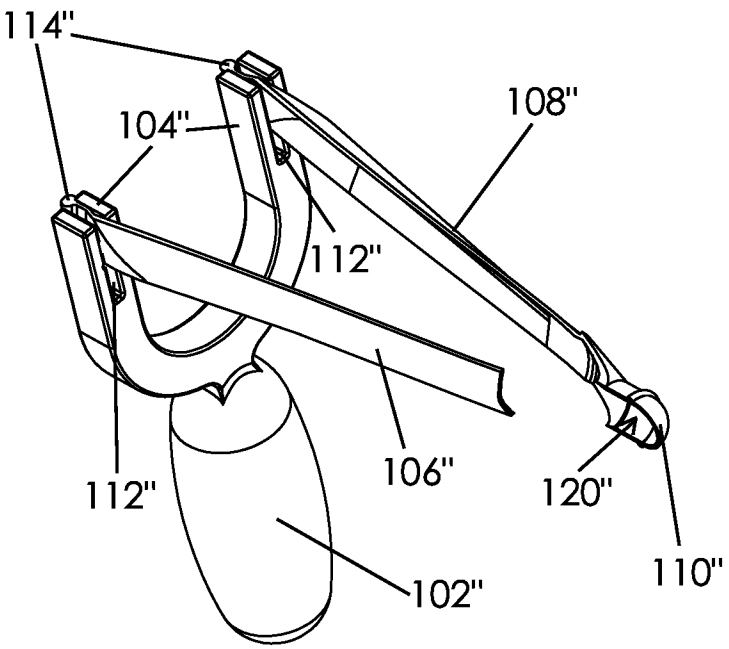
FIG. 23 is a perspective cutaway view of the resiliently stretchable band shown in FIG. 22.
Figure 22:
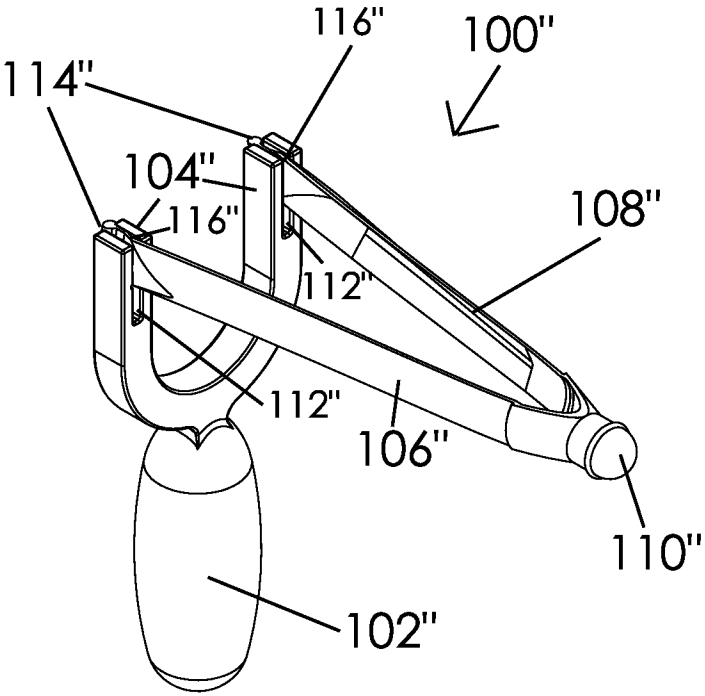
FIG. 22 is a perspective view of another embodiment of an improved slingshot.

Referring to FIGS. 22 and 23, another embodiment of a slingshot 100" is shown comprising resiliently stretchable band first and second portions 106" and 108" that are coupled to a hand grip 102" via arms 104". A pouch 110" is positioned intermediate resiliently stretchable band first and second portions 106" and 108" and forms a cavity 120" for releasably receiving a projectile (not shown). In various embodiments, resiliently stretchable band first and second portions 106" and 108" and pouch 110" are integrally formed from a suitable resiliently stretchable material such as rubber, elastomer, etc. Resiliently stretchable band first and second portions 106" and 108" are coupled to arms 104" via respective slots 112" formed in each arm 104". Mounting portions 114" are sized and shaped to prevent the resiliently stretchable band ends 116" from slipping out of slots 112". In the embodiments disclosed in FIGS. 22-23, pouch cavity 120" is semicircular in shape to releasably receive a round projectile. It should be understood that the shape of the cavity can differ depending on the shape of the projectile to be launched by slingshot 100". In various embodiments, the user can change the resiliently stretchable band first and second portions 106" and 108" and pouch 110" to a different resiliently stretchable band and pouch depending on the type of projectile that the user wishes to launch using slingshot 100". This can be easily accomplished by sliding the resiliently stretchable band first and second band ends 116" out from slots 112" and inserting a different band and pouch.

CONCLUSION

Many modifications and other embodiments of the invention will come to mind to one skilled in the art to which this invention pertains having the benefit of the teachings presented in the foregoing descriptions and the associated drawings. For example, as will be understood by one skilled in the relevant field in light of this disclosure, the invention may take form in a variety of different mechanical and operational configurations. For example, resiliently stretchable band first and second portions 106" and 108" and pouch 110" may be used in the slingshot embodiment 100 in FIGS. 16-19 or FIGS. 20-21. Additionally, one or more parts of the resiliently stretchable band first and second portions 106 and 108, and pouch 110 may be integrally formed from the same material or they may be formed from different material and operatively coupled to one another. Finally, features of the pouches or bands from the embodiments shown in FIGS. 1-15 may be incorporated into the slingshot embodiments shown in FIGS. 16-23.

Therefore, it is to be understood that the invention is not to be limited to the specific embodiments disclosed herein, and that the modifications and other embodiments are intended to be included within the scope of the appended exemplary concepts. Although specific terms are employed herein, they are used in a generic and descriptive sense only and not for the purposes of limitation.

What is claimed:

1. An improved slingshot comprising:

a. a grip comprising:

i. a handle;

ii. a first arm coupled to the handle; and iii. a second arm coupled to the handle;

b. a first resiliently stretchable first sling comprising:

i. a first resiliently stretchable band comprising a first end and an opposite second end;

ii. a second resiliently stretchable band comprising a third end and an opposite fourth end;

iii. a first mounting formation integrally formed with the first resiliently stretchable band second end;

iv. a second mounting formation integrally formed with the second resiliently stretchable band fourth end; and v. a first pouch integrally formed with the first resiliently stretchable band first end and the second resiliently stretchable band third end;

wherein, the first resiliently stretchable band, the second resiliently stretchable band, the pouch and the first and the second mounting formations are all formed from the same material;

the first mounting formation is configured to be releasably attached to the first arm; and the second mounting formation is configured to be releasably attached to the second arm;

a second sling comprising:

a. a third resiliently stretchable band comprising a fifth end and an opposite six end;

b. a fourth resiliently stretchable band comprising a seventh end and an opposite eighth end;

c. a third mounting formation integrally formed with the third resiliently stretchable band sixth end;

d. a fourth mounting formation integrally formed with the fourth resiliently stretchable band eighth end; and e. a second pouch integrally formed with the third resiliently stretchable band fifth end and the fourth resiliently stretchable band seventh end;

wherein, the third resiliently stretchable band, the fourth resiliently stretchable band, the second pouch and the third and the fourth mounting formations are all formed from the same material;

the third mounting formation is configured to be releasably attached to the first arm; and the fourth mounting formation is configured to be releasably attached to the second arm;

a. the first pouch defining a first cavity having a first shape;

b. the second pouch defining a second cavity having a second shape; and c. the first shape and the second shape differ.

2. The improved slingshot of claim 1, wherein the material is rubber.

3. The improved slingshot of claim 1, wherein the material is latex.

4. The improved slingshot of claim 1, wherein either the first or second pouch defines a cavity therein that is substantially semicircular.

5. The improved slingshot of claim 1, wherein a. the first mounting formation is substantially flat; and b. the second mounting formation is substantially flat.

6. The improved slingshot of claim 5, wherein a. the first mounting formation is releasably attached to the first arm using a first clip; and b. the second mounting formation is releasably attached to the second arm using a second clip.

7. The improved slingshot of claim 1, wherein a. the first arm comprises a first slot formed therein that is configured to releasably receive one of the first mounting formation and the third mounting formation therein; and b. the second arm comprises a second slot formed therein that is configured to releasably receive one of the second mounting formation and the fourth mounting formation therein.

* * * * *